US009105454B2

(12) United States Patent
Ristroph et al.

(10) Patent No.: US 9,105,454 B2
(45) Date of Patent: Aug. 11, 2015

(54) PLASMA-BASED ELECTRON CAPTURE DISSOCIATION (ECD) APPARATUS AND RELATED SYSTEMS AND METHODS

(71) Applicant: Agilent Technologies, Inc., Santa Clara, CA (US)

(72) Inventors: Trygve Ristroph, Santa Clara, CA (US); Mark Denning, Santa Clara, CA (US); Kenneth R. Newton, Santa Clara, CA (US); Guthrie Partridge, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 14/483,462

(22) Filed: Sep. 11, 2014

(65) Prior Publication Data

US 2015/0122985 A1 May 7, 2015

Related U.S. Application Data

(60) Provisional application No. 61/900,563, filed on Nov. 6, 2013.

(51) Int. Cl.
*H01J 49/00* (2006.01)
*H01J 49/10* (2006.01)
*H01J 49/26* (2006.01)

(52) U.S. Cl.
CPC ..... *H01J 49/0054* (2013.01); *H01J 49/0031* (2013.01); *H01J 49/10* (2013.01); *H01J 49/26* (2013.01)

(58) Field of Classification Search
CPC ..... H01J 49/0072; H01J 49/45; H01J 49/54; H01J 49/0031; H01J 49/10; H01J 49/26
USPC ..... 250/281, 282, 288, 290
See application file for complete search history.

(56) References Cited

U.S. PATENT DOCUMENTS

| | | | | |
|---|---|---|---|---|
| 7,408,360 | B2 | 8/2008 | Sheverev | |
| 7,534,622 | B2 * | 5/2009 | Hunt et al. | 436/173 |
| 8,334,507 | B1 * | 12/2012 | Whitehouse et al. | 250/292 |
| 8,575,542 | B1 * | 11/2013 | Park et al. | 250/281 |
| 2003/0183760 | A1 | 10/2003 | Tsybin et al. | |

(Continued)

FOREIGN PATENT DOCUMENTS

| | | | |
|---|---|---|---|
| WO | 2006133025 | A2 | 12/2006 |
| WO | 2013/081195 | A1 | 6/2013 |

OTHER PUBLICATIONS

Zubarev RA, Kelleher NL, McLafferty FW (1998) "Electron capture dissociation of multiply charged protein cations. A nonergodic process", J. Am. Chem. Soc. 120 (13) pp. 3265-3266.

(Continued)

*Primary Examiner* — Michael Maskell

(57) ABSTRACT

An electron capture dissociation (ECD) apparatus includes a plasma source for generating plasma. Analyte ions are exposed to the plasma in an ECD interaction region, either inside or outside the plasma source. The apparatus may include one or more devices for refining the plasma in preparation for interaction with the analyte ions. Refining may entail removing unwanted species from the plasma, such as photons, metastable particles, neutral particles, and/or high-energy electrons unsuitable for ECD, and/or controlling a density of low-energy electrons in the plasma.

20 Claims, 10 Drawing Sheets

(56) References Cited

U.S. PATENT DOCUMENTS

2011/0049347 A1 3/2011 Wells
2011/0233397 A1 9/2011 Barofsky et al.

OTHER PUBLICATIONS

J Xue, J E Cooley and R S Urdahl, 2012, J. Phys. D: Appl. Phys. 45 365201.

European Search Report for EP 14 19 1747, mailed on Mar. 11, 2015.

Tsybin Y. O. et al.; "Electron Capture Dissociation Implementation Progress in Fourier Transform Ion Cyclotron Resonance Mass Spectrometry", Journal of the American Society for Mass Spectrometry, Elsevier Science Inc., US, vol. 19, No. 6 Jun. 2008, pp. 762-771.

* cited by examiner

PLASMA-BASED ELECTRON CAPTURE DISSOCIATION (ECD) APPARATUS AND RELATED SYSTEMS AND METHODS

RELATED APPLICATIONS

This application claims the benefit of U.S. Provisional Patent Application Ser. No. 61/900,563, filed Nov. 6, 2013, titled "PLASMA-BASED ELECTRON CAPTURE DISSOCIATION (ECD) APPARATUS AND RELATED SYSTEMS AND METHODS," the content of which is incorporated by reference herein in its entirety.

TECHNICAL FIELD

The present invention relates generally to plasma-based electron capture dissociation (ECD), and in particular to optimizing plasma for ECD.

BACKGROUND

Mass spectrometry (MS) is often utilized to characterize large (high molecular-weight) molecules including long-chain biopolymers (e.g., peptides, proteins, etc.). In the simplest typical work flow, intact large molecules are separated, ionized, and introduced to a mass spectrometer where the ion mass-to-charge (m/z) ratio is measured and utilized to deduce molecular formulae. In tandem mass spectrometry (MS/MS), additional information is gained by expanding the workflow to include a fragmentation step in which an ion or ions of interest ("precursor" or "parent" ions) are isolated by m/z ratio and then dissociated (fragmented) into smaller "product" or "fragment" ions. The fragment masses offer complementary molecular information and consequently play an important role in characterizing large molecules in situations where the mass measurement alone is inadequate.

Numerous fragmentation methods exist, each with its own merits and disadvantages. The mechanism for dissociation usually performed in a Paul trap or other type of radio frequency (RF) based ion processing device is collision-induced dissociation (CID), also referred to as collision-activated dissociation (CAD). CID entails accelerating a parent ion to a high kinetic energy in the presence of a background neutral gas (or collision gas) such as helium, nitrogen or argon. When the excited parent ion collides with the gas molecule, some of the parent ion's kinetic energy is converted into internal (vibrational) energy. If the internal energy is increased high enough, the parent ion will break into one or more fragment ions, which may then be mass-analyzed. A similar mechanism is employed in Penning traps, known as sustained off-resonance irradiation (SORI) CID, which entails accelerating the ions so as to increase their radius of cyclotron motion in the presence of a collision gas. An alternative to CID and SORI-CID is infrared multiphoton dissociation (IRMPD), which entails using an IR laser to irradiate the parent ions whereby they absorb IR photons until they dissociate into fragment ions. IRMPD is also based on vibrational excitation (VE).

CID and IRMPD are not considered to be optimal techniques for dissociating ions of large molecules such as peptides and proteins. For many types of large molecules these VE-based techniques are not able to cause the types of bond cleavages, or a sufficient number of these cleavages, required to yield a complete structural analysis. Currently, electron capture dissociation (ECD) is being investigated as a promising new method for dissociating large molecular ions. In ECD, the well-known technique of electrospray ionization (ESI) is usually selected to produce positive, multiply-charged ions of large molecules by proton attachment. The "soft" or "gentle" technique of ESI leaves the multiply-charged ions intact, i.e., not fragmented. The ions are then irradiated by a stream of low-energy free electrons. If their energy is low enough (typically less than 3 eV), the electrons can be captured by the positively charged sites on the ions. The energy released in the exothermic capture process is released as internal energy in the ion, which can then very quickly cause bond cleavage (at a peptide backbone, for example) and dissociation. ECD is considered to be a particularly powerful method for fragmenting intact proteins and large peptides. The advantages of ECD are that the fragmentation pattern is simple and predictable, which aids in protein identification, and post-translation modifications of the amino acid residues are kept intact throughout the fragmentation process.

State of the art ECD systems use heated cathode filaments as the source of electrons, which are liberated from the filament surfaces by thermionic emission. This type of device is commonly used in conjunction with "hard" electron impact (EI) ionization and other processes requiring the production of an intense electron beam. To reach high electron thermionic emission currents, the filaments are heated to at least several hundred degrees Kelvin, which heats the wires delivering the filament current as well as the surrounding system. The magnetic fields generated by the filament current as well as electric field from the voltage drop across the filament must also be considered in the design. Additionally, the high extraction voltage required to form an electron beam from a heated filament surface produces high energy electrons, which are not suitable for ECD as noted above. Moreover, when the filament is operating at the space-charge limit for the low electron energies (less than 2 eV), the electron density is low, resulting in either low efficiency or requiring very long interaction distances and times. In the state of the art ECD mass spectrometers based on magnetic trapping (i.e., Fourier transform ion-cyclotron resonance MS), the low electron density is offset by long interaction distances and times. The resulting system does not have high throughput and does not operate on a time-scale compatible with modern chromatographic separations.

As an alternative to an electron beam produced by thermionic emission, plasma can serve as an excellent source of a high-density population of electrons. However, there are a number of other species of particles present in plasma. In a plasma for which the gas employed is a noble gas, the most important of these species are: (1) plasma electrons—free electrons created by ionizing collisions, which exhibit a range of energies; (2) plasma ions—positively charged ions created in the same ionizing collisions; (3) metastable atoms—neutral atoms that have stored energy in a long-lived metastable state as a result of non-ionizing collisions; (4) ultraviolet (UV) photons—UV light generated by the collisional excitation and decay of atoms; and (5) neutral atoms—unexcited neutral atoms, typically at a density much higher than all other species. Of all of these species, only low-energy (less than 3 eV) plasma electrons meet the requirements for successful fragmentation of analyte parent ions through the mechanism of ECD. High-energy plasma electrons and all other species are undesirable as they may cause unwanted ionization or dissociation events that serve only as background noise in the resulting mass spectrum.

Therefore, there is a need for plasma-based ECD apparatuses and methods. There is also a need for plasma-based ECD apparatuses and methods capable of removing unwanted plasma species from the plasma. There is also a need for plasma-based ECD apparatuses and methods capable of producing optimal densities of low-energy plasma electrons.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, electron capture dissociation (ECD) apparatus includes: a plasma source configured for generating plasma; a plasma refinement device configured for converting the generated plasma to refined plasma comprising predominantly low-energy electrons suitable for ECD and plasma ions; and a chamber configured for receiving an ion beam in an interaction region containing the refined plasma.

According to another embodiment, mass spectrometer (MS) system includes: the ECD apparatus; an ion source for producing analyte ions from a sample and communicating with the ECD apparatus; a mass analyzer communicating with the ECD apparatus.

According to another embodiment, a method for performing electron capture dissociation (ECD) includes: generating plasma; forming a refined plasma from the generated plasma wherein the refined plasma comprises predominantly low-energy electrons suitable for ECD and plasma ions; and directing an ion beam into the refined plasma.

According to another embodiment, a method for analyzing a sample includes: subjecting analyte ions to electron capture dissociation (ECD) to produce fragment ions; and transferring at least some of the fragment ions to a mass analyzer.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

As discussed above, the ECD fragmentation pattern is desirable in many applications, but conventional electron sources for ECD suffer from low efficiency and a potentially large heat load on the surrounding system. To reach high ECD efficiency in short times and small interaction distances, it is desired to use as dense a source of low energy electrons as possible. Embodiments disclosed herein generate plasma having an electron density that is many orders of magnitude greater than the density near the surface of the filaments conventionally employed as an electron source. Additionally, embodiments disclosed herein allow positive ions to neutralize the electrostatic repulsion of electrons and thereby significantly reduce the net space-charge repulsive force that could impair the production of high-density, low-energy electron fields required for efficient ECD fragmentation, particularly when performing ECD on a short time scale. Additionally, some embodiments disclosed herein provide devices and methods for refining the plasma generated so as to filter out the undesirable species of the plasma. Additionally, some embodiments disclosed herein provide devices and methods for controlling the density of low-energy electrons in the plasma so as to tune the conditions under which ECD occurs. Additionally, one or more embodiments disclosed herein may consume less power and reduce the amount of heating of neighboring parts of the system, as compared to conventional electron sources.

In the context of the present disclosure, "plasma" ions are ions formed by generating and thereafter sustaining plasma from a plasma-forming background or working gas (argon, helium, etc.). Plasma ions are distinguished from "analyte" or "sample" ions, which are ions formed by ionization of sample molecules. Accordingly, analyte ions are the ions of interest in a spectrometric analysis of sample material, as opposed to plasma ions. In the context of spectrometry, plasma ions generally do not contribute to the ion signal in useful manner. However, plasma ions may be exploited to ameliorate space charge effects, as described below.

Figure 1:
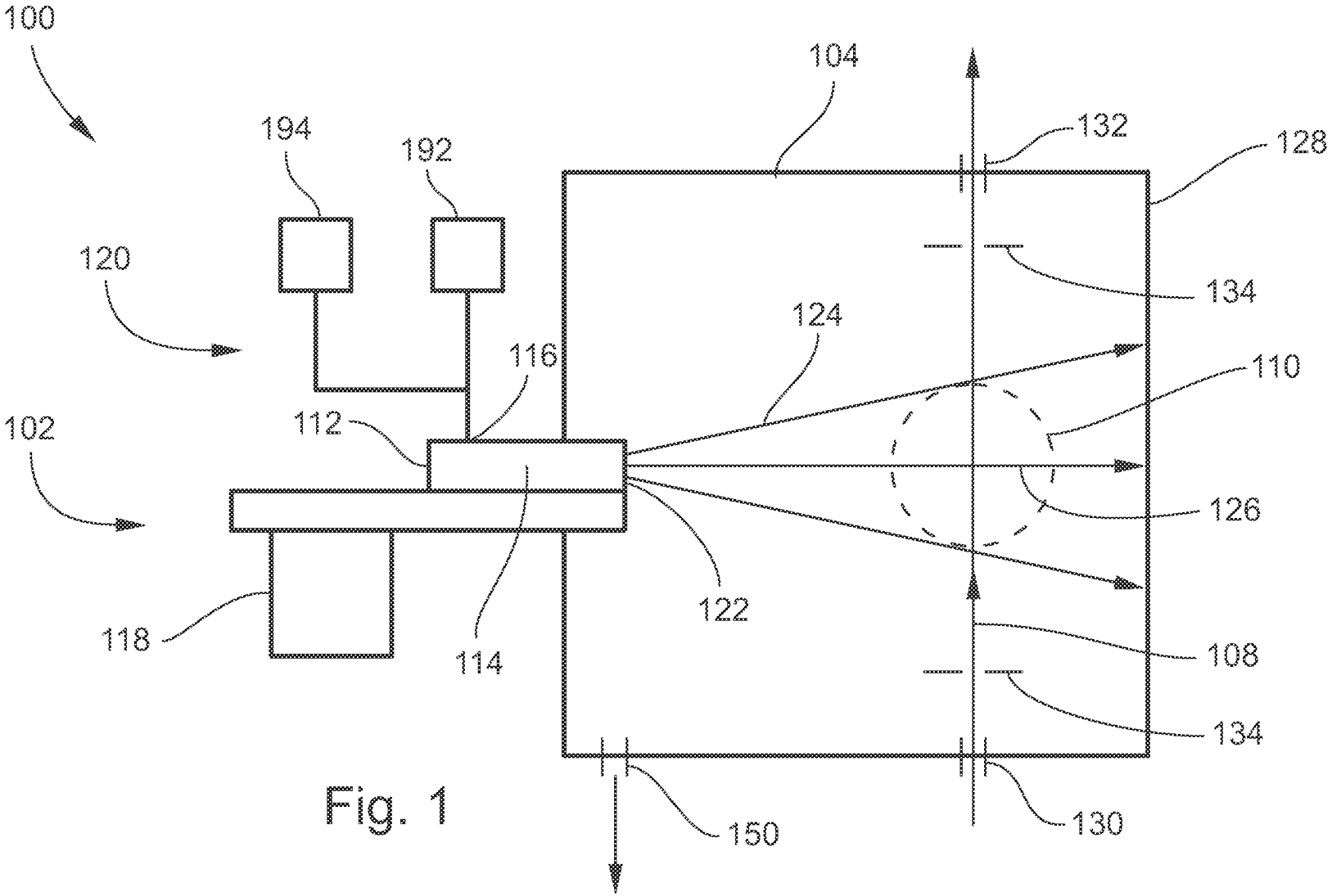
FIG. 1 is a schematic view of an example of an electron capture dissociation (ECD) apparatus according to some embodiments.

FIG. 1 is a schematic view of an example of an electron capture dissociation (ECD) apparatus 100 according to some embodiments. The ECD apparatus 100 generally includes a plasma source 102 configured for generating plasma, and an ECD chamber (or cell) 104 configured for receiving a beam 108 of analyte ions in an ECD interaction region or zone 110 containing the plasma. The plasma source 102 generally includes a housing 112 enclosing a plasma source interior (or plasma-forming chamber) 114, a gas inlet 116 for introducing a plasma-forming gas into the source interior 114, and an energy source 118 configured for generating the plasma from the plasma-forming gas in the source interior 114. The plasma may be generated by various known techniques. The plasma is typically driven by DC electric or AC electromagnetic power. As examples, the energy source 118 may include electrodes coupled to a direct current (DC), alternating current (AC) or radio frequency (RF) voltage source, and may further include one or more dielectric barriers, resonant cavities, microstrips, and/or magnets. Accordingly the plasma may be, for example, a DC or AC glow discharge, corona discharge, RF capacitive or inductive discharge, dielectric barrier discharge (DBD), or microwave discharge. The mechanism for generating the plasma may be based on resonant coupling of energy or formation of excimers. A gas supply system 120 is configured for delivering any selected gas or combination of gases to the plasma source 102 at a desired gas flow rate (or pressure). The plasma-forming gas may be, for example, a noble gas (helium, neon, argon, krypton, or xenon), a combination of two or more noble gases, or a combination of a non-noble gas (e.g., hydrogen, or a halogen such as fluorine, chlorine or bromine) with one or more noble gases. Various types of plasmas, and the design and operating principles of various types of energy sources utilized to generate plasmas, are generally known to persons skilled in the art and thus for purposes of the present disclosure need not be described further.

No specific limitation is placed on the size of the plasma source 120. The size generally depends on the application. By example only, FIG. 1 schematically depicts the plasma source 120 in the form of a microplasma chip configured for producing a microwave-excited microplasma (small-scale plasma), which may be fabricated by known microfabrication techniques using suitable materials. As non-limiting examples, the plasma source 120 may include features and functions similar to those described in U.S. Patent Application Publication Nos. 2010/0032559 and 2011/0175531, the contents of which are incorporated herein by reference. A chip-based, microwave-excited microplasma may be advantageous in many applications. This type of plasma source is a compact, thermally efficient source of high densities of all plasma species, in particular very high densities of low-energy electrons which are important for high-efficiency ECD. In a chip-based microplasma source the electron density may, for example, be $1\times10^{13}$ $cm^{-3}$ and an average electron energy (temperature) near 2 eV, which is a good match to ECD requirements. In operation, the plasma gas and chip are close to ambient temperature. A chip-based microplasma source may consume only watts of power and operate in vacuum with simple thermal design.

In the present embodiment, the flow of plasma-forming gas is continuous to maintain a desired pressure in the source interior 114. The housing 112 includes a plasma outlet 122 through which a plasma plume 124 is emitted from the source interior 114 into the ECD chamber 104. The flow of plasma through the plasma outlet 122 may be driven by various means, such as the flow of gas through the source interior 114 and/or a pressure differential between the source interior 114 and the chamber 104. The plasma plume 124 flows through the chamber 104 generally along a nominal plasma flux axis 126 to the ECD interaction region 110, i.e., the region where the analyte ion beam 108 intersects the plasma plume 124. The plasma flux axis 126 may be straight or curved as described further below. The plasma plume 124 terminates at a termination wall 128 (plasma loss surface) of the ECD chamber 104 beyond the interaction region 110. Plasma species are neutralized at the termination wall 128 and pumped away. A plasma sheath will form in a region near the termination wall 128, where plasma ions are accelerated towards the termination wall 128 by the positive plasma potential and where electrons are depleted. It is undesirable for the analyte ion beam 108 to overlap with this sheath because the electron density drops substantially in this region and the electron energy distribution is also affected. The analyte ion beam 108 should therefore pass through the plasma flux sufficiently far from the termination wall 128 to avoid sheath effects.

As schematically illustrated, the plasma plume 124 tends to diverge with distance from the plasma outlet 122. The ECD apparatus 100 may include a device configured for confining the plasma plume 124 to a more uniform beam or tube shape focused along the plasma flux axis 126, as described by examples below.

Parent ions are produced from a sample in an ion source upstream of the ECD apparatus 100, and are transferred into the ECD chamber 104 as an analyte ion beam 108 via an ion inlet 130. The analyte ion beam 108 passes through the plasma plume 124 at the ECD interaction region 110 along an analyte ion optical axis, resulting in at least some of the parent ions being dissociated into fragment ions through the mechanism of ECD. The fragment ions (or mixture of fragment ions and non-dissociated parent ions) exit the ECD chamber 104 via an ion outlet 132. The analyte ion beam 108 may be focused in the ECD chamber 104 by any suitable device such as a system of electrostatic lenses, which may for example include the ion inlet 130, ion outlet 132, and one or more additional lenses 134 in the ECD chamber 104. The ion outlet 132 is shown by example as being aligned with the ion inlet 130, but need not be.

As an alternative or addition to the use of electrostatic lenses, the analyte ions may be confined within a radio frequency (RF) confining device such as a multi-pole ion guide or an ion funnel located in the ECD chamber 104. In this case, the set of electrodes of the RF confining device (elongated rods, rings, etc.) may surround the ECD interaction region 110. The plasma plume 124 may be directed at or into the entrance of the RF confining device or through a gap between adjacent electrodes of the RF confining device. The RF confining device may be useful for lengthening the ECD interaction time. Moreover, an inert buffer gas may be directed into the interior space of the RF confining device. The buffer gas may be useful for damping excessive electron kinetic energy. Because the electrons will be heated by the RF confining field, it may be desirable to utilize a high-order multi-pole (e.g., hexapole, octopole, etc.) or large ion funnel in which the electric field on-axis is very low.

Figure 2:
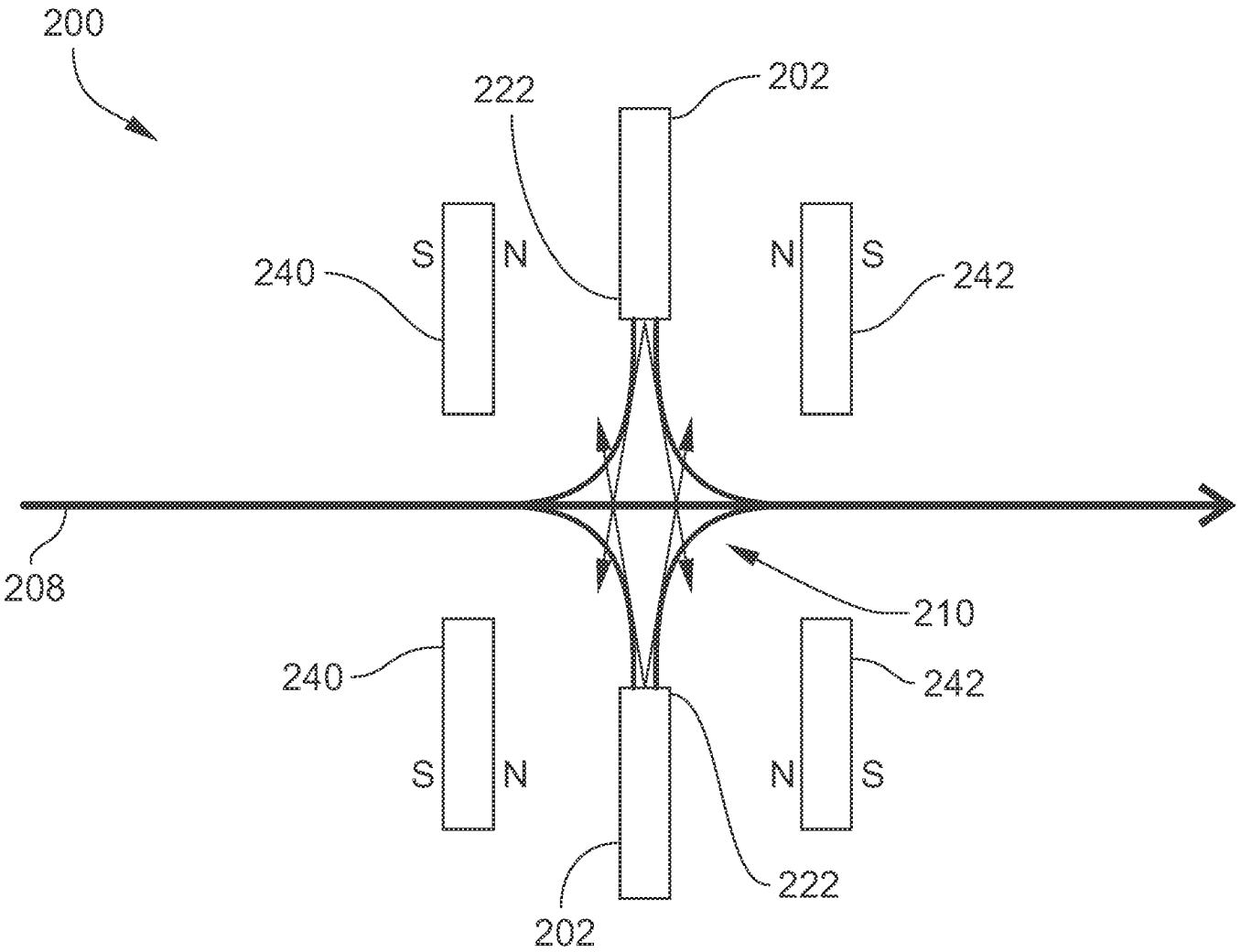
FIG. 2 is a schematic view of an example of an ECD apparatus according to another embodiment.

FIG. 2 is a schematic view of an example of an ECD apparatus 200 according to another embodiment. The ECD apparatus 200 generally includes a plasma source 202 configured for generating plasma, and an ECD chamber (not specifically shown) configured for receiving an analyte ion beam 208 in an ECD interaction region 210 containing the plasma. In this embodiment, the plasma source 202 includes a plurality of plasma outlets 222 arranged to direct a plurality of respective plasma plumes into the ECD interaction region 210 to intersect with the analyte ion beam 208. For simplicity, two plasma outlets 222 are shown with the understanding that more than two plasma outlets 222 may be provided. The plasma outlets 222 may be spaced from each other, spaced from the analyte ion optical axis, and oriented relative to the analyte ion optical axis, according to any suitable configuration. In the illustrated embodiment, the plasma outlets 222 are arranged in a ring about the optical axis such that their plasma plumes are directed toward the optical axis in radial (orthogonal) directions. In other embodiments, the plasma outlets 222 may be oriented at other angles relative to the optical axis. In some embodiments, the plasma source 202 may be a single device with a plenum leading to the multiple plasma outlets. In other embodiments, as illustrated in FIG. 2, the plasma source 202 may include a plurality of individual plasma source devices or units, each including a plasma outlet 222. Each plasma source device may, for example, be configured the same as or similar to the plasma source 102 described above in conjunction with FIG. 1.

As further illustrated in FIG. 2, the ECD apparatus 200 may include a magnetic device configured for forming a magnetic field pattern that entrains the plasma electrons into a region along and close to the analyte ion optical axis. For example, the magnetic device may include opposing ring magnets 240 and 242, shown in cross-section in FIG. 2. The magnetic field may increase the path length for interaction of the electrons with the analyte ions, and/or increase the number of electrons per unit length along the optical axis through the ECD interaction region 210. The positive plasma ions will not be affected by the magnetic field, but will be attracted to the space charge from the electrons.

Referring back to FIG. 1, in some embodiments, the plasma at the ECD interaction region 110 may by composed of all of the different types of plasma species (plasma electrons, plasma ions, metastable atoms, UV photons, and neutral atoms) in non-negligible quantities. This may result in a full range of fragmentation mechanisms occurring simultaneously. In addition to ECD by interaction with low-energy electrons, such fragmentation mechanisms may include fragmentation by impact with high-energy electrons, photo-dissociation by incident photons, and Penning ionization by collision with metastable atoms. The simultaneous occurrence of different fragmentation mechanisms may result in fragmentation patterns unique to methods currently employed, and therefore may be of interest as an analytical method. However, the resulting fragmentation spectra may be difficult to interpret, as it may be difficult to determine which mechanisms played the greatest role in producing the spectrum and in what way. For many applications, it may be more desirable to select a particular plasma species for a particular fragmentation mechanism, and to filter out the other species. For example, when the focus of an analysis is fragment ion spectra based on ECD, ion measurement signals resulting from other fragmentations mechanisms may be considered as signal noise that must be accounted for.

Specifically in the case of performing ECD, it is desirable to provide a high density of low-energy electrons and to prevent other types of particles (plasma species) from interacting with the analyte ions. To accomplish this, embodiments disclosed herein provide devices and methods for refining (or filtering) the plasma generated by the plasma source 102. In the present disclosure, a plasma refinement device is a device configured for converting the generated plasma to refined plasma that is composed of an abundance of low-energy electrons suitable for ECD relative to other particles. To achieve this, the plasma refinement device may be configured for removing (or filtering out) from the plasma one or more of the following particles: photons, metastable particles, neutral particles, and high-energy electrons unsuitable for ECD. As examples, low-energy electrons suitable for ECD may be electrons having energies of about 3 eV or less, while high-energy electrons unsuitable for ECD may be electrons having energies of greater than 3 eV. As further examples, depending on the method or analysis being implemented, it may be more desirable that the low-energy electrons have energies of 2 eV or less, or 1 eV or less, or 0.5 eV or less. It has been found that the ECD cross-section increases monotonically with decreasing electron energy. See Al-Khalili et al., "Dissociative recombination cross section and branching ratios of protonated dimethyl disulfide and N-methylacetamide," J. Chem. Phys., Vol. 121, No. 12, 2004, p. 5700-5708. Thus, for many applications it is desirable that the electrons utilized for ECD be as cool as possible. Removing unwanted particles may entail eliminating such particles from the plasma, or reducing their population down to negligible quantities, such that the particles do not adversely affect the ECD process or the subsequent spectral measurement process. It is desired that the refined plasma delivered to the ECD interaction region 110 consists entirely or almost entirely of cold plasma ions and cold plasma electrons, with only trace populations of photons and neutral particles. Accordingly, the refined plasma may be characterized as being composed of predominantly low-energy electrons suitable for ECD and plasma ions, with all other plasma species being absent or present in negligible amounts. Examples of plasma refinement devices and methods are described below.

Referring to FIG. 1, as one example of a plasma refinement device, the ECD apparatus 100 may include a vacuum port 150 leading out from the ECD chamber 104 to a vacuum system (e.g., a pump and associated plumbing, not shown). The vacuum port 150 is useful for removing metastable particles and neutral particles. The vacuum port 150 is particularly effective when utilized in conjunction with a plasma confining device in the ECD chamber 104, examples of which are described below.

Figure 3:
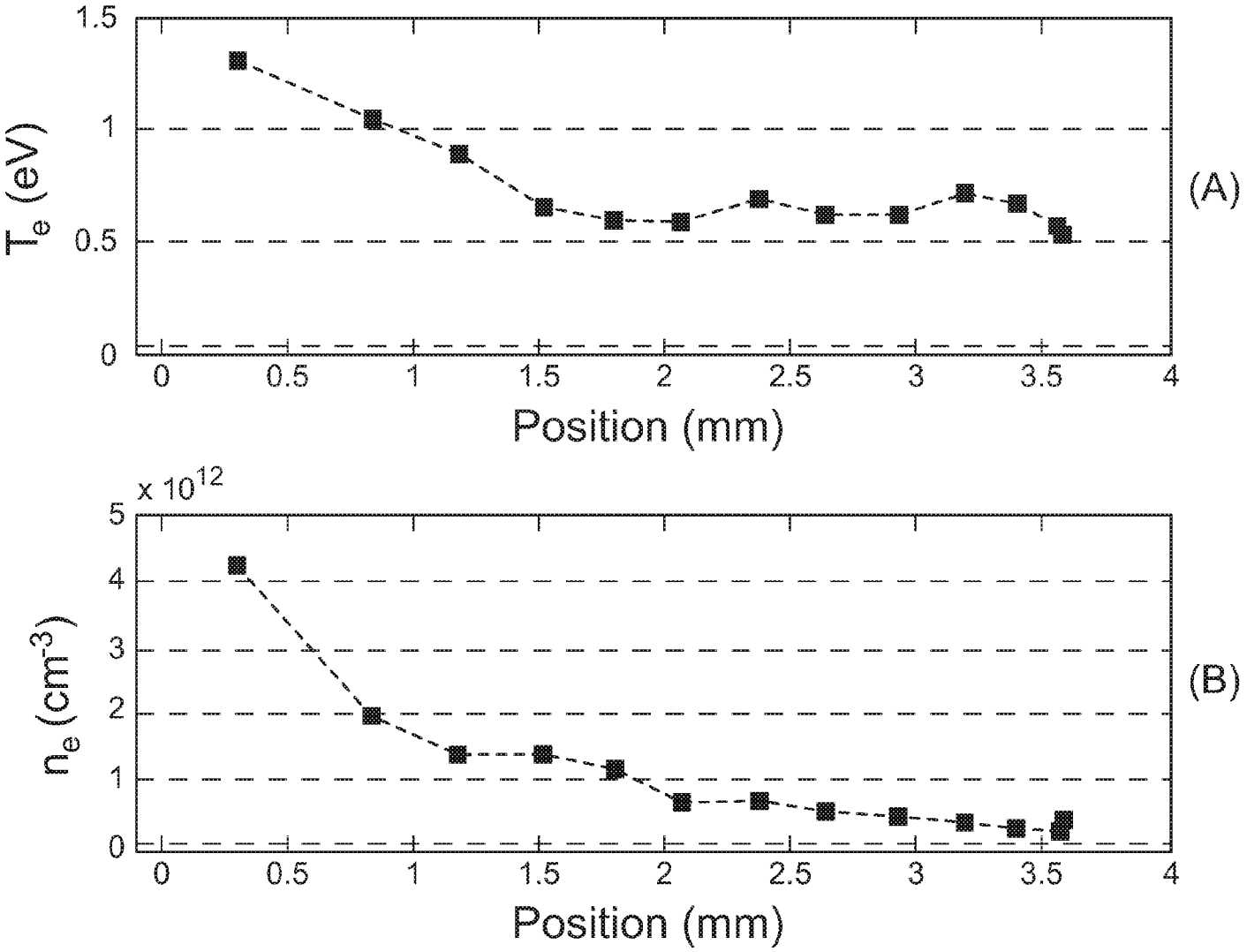
FIG. 3A is a plot of electron temperature $T_e$ (eV) as a function of position (mm).
FIG. 3B is a plot of electron density $n_e$ ($cm^{-3}$) as a function of position (mm).

Through experimental observations based on Thomson scattering diagnostics, it has been discovered that there is a spatial gradient in both electron temperature (energy) and electron density in the plume region in front of the plasma outlet of a microplasma chip-based plasma source. FIGS. 3A and 3B are plots of the Thomson scattering data. Specifically, FIG. 3A is a plot of electron temperature $T_e$ (eV) as a function of position (mm) (axial distance from plasma outlet), and FIG. 3B is a plot of electron density $n_e$ ($cm^{-3}$) as a function of position (mm). These observations provide further insights into ways to optimize plasma for ECD.

For example, the ECD chamber 104 may be sufficiently sized to include a region that functions as an electron cooling sector between the plasma outlet 122 and the ECD interaction region 110. In the plasma source 102 the electron temperature is typically 2 or more eV, determined primarily by the gas pressure, gas constituents, and geometry of the plasma source interior 114. Once the plasma flux leaves the plasma source 102 and thus is no longer undergoing active excitation, the electrons immediately begin to cool through collisions with neutral particles and plasma ions (see, e.g., FIG. 3A). The region just beyond the plasma outlet 122 thus functions as a cooling sector to thermalize the electrons with the cold plasma ions. The ECD interaction region 110 may be located (as defined by the intersection of the analyte ion beam 108 with the plasma plume 124) at a distance from the plasma outlet 122 sufficient to bring the electron temperature down to a level favorable for ECD. For example, at the point the plasma plume reaches the ECD interaction region 110 the electrons and plasma ions may have equilibrated to a common temperature of approximately 0.5 eV or less.

Figure 4:
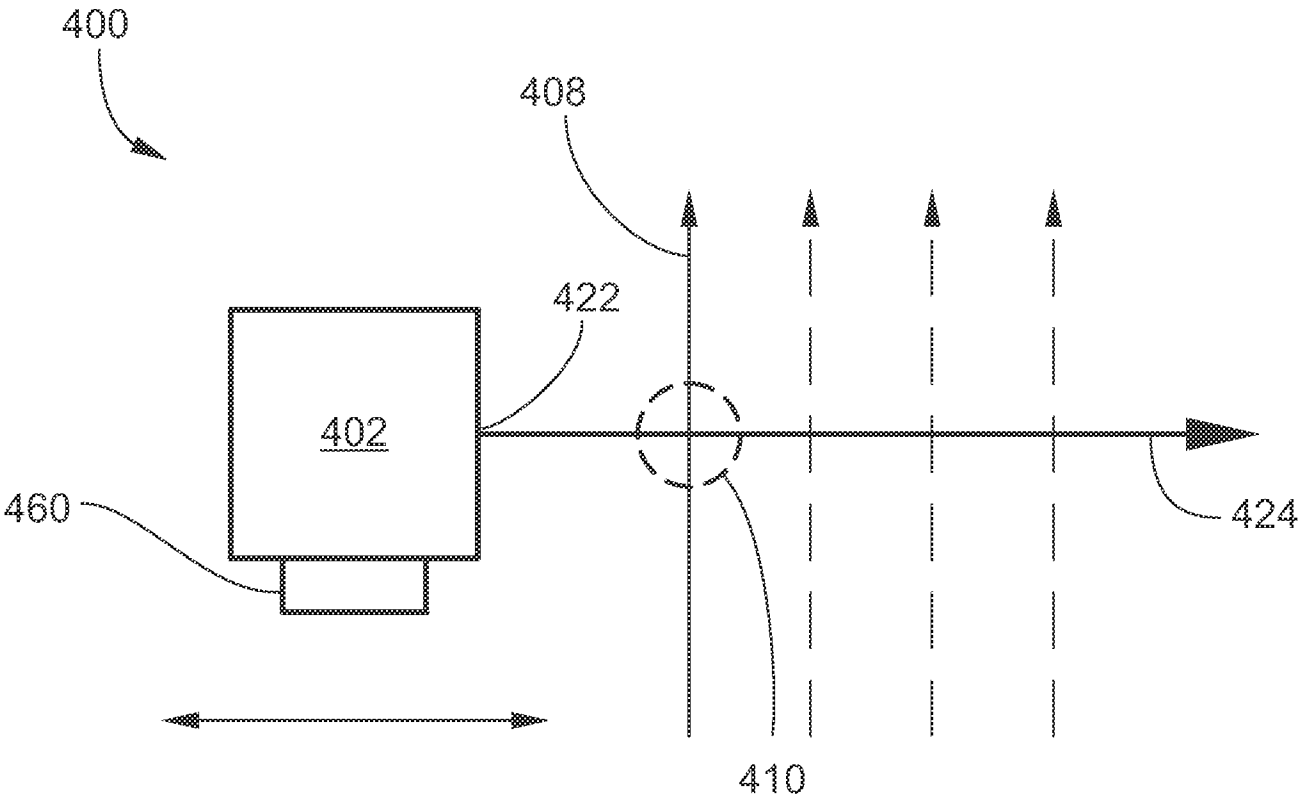
FIG. 4 is a schematic view of an example of an ECD apparatus according to another embodiment.

As another example, the ECD apparatus may include a device for controlling (adjusting) the location of the plasma outlet relative to the ECD interaction region (or equivalently, the ECD interaction region relative to the plasma outlet), i.e., for controlling (adjusting) a position relative to the plasma outlet at which the ion beam passes through the plasma plume. FIG. 4 is a schematic view of an ECD apparatus 400 in which a plasma plume 424 discharged from a plasma outlet 422 of a plasma source 402 crosses an analyte ion beam 408 at an ECD interaction region 410. The position of the analyte ion beam 408 (and thus the ECD interaction region 410) relative to the plasma outlet 422 may be adjusted to other locations as depicted by dashed lines. The ECD apparatus 400 includes a position-adjusting device configured for this purpose. The position-adjusting device may be configured for moving the plasma outlet 422 relative to the analyte ion beam 408. As an example, the position-adjusting device may include a linear stage 460 mechanically referenced to the plasma source 402 to translate the plasma source 402 toward or away from the analyte ion beam 408, as indicated by an arrow. Alternatively, the position-adjusting device may be configured for moving the analyte ion beam 408 relative to the plasma outlet 422. As an example, the position-adjusting device may include a system of ion optics configured for steering the analyte ion beam 408 to a selected location along the length of the plasma plume 424, such as deflection electrodes, movable ion reflectors, etc., as appreciated by persons skilled in the art. Alternatively, the position-adjusting device may be configured for moving both the plasma outlet 422 and the analyte ion beam 408. Such configurations enable control over the electron temperature/density (see, e.g., FIGS. 3A and 3B) that the analyte ions encounter in the ECD interaction region 410.

Figure 5:
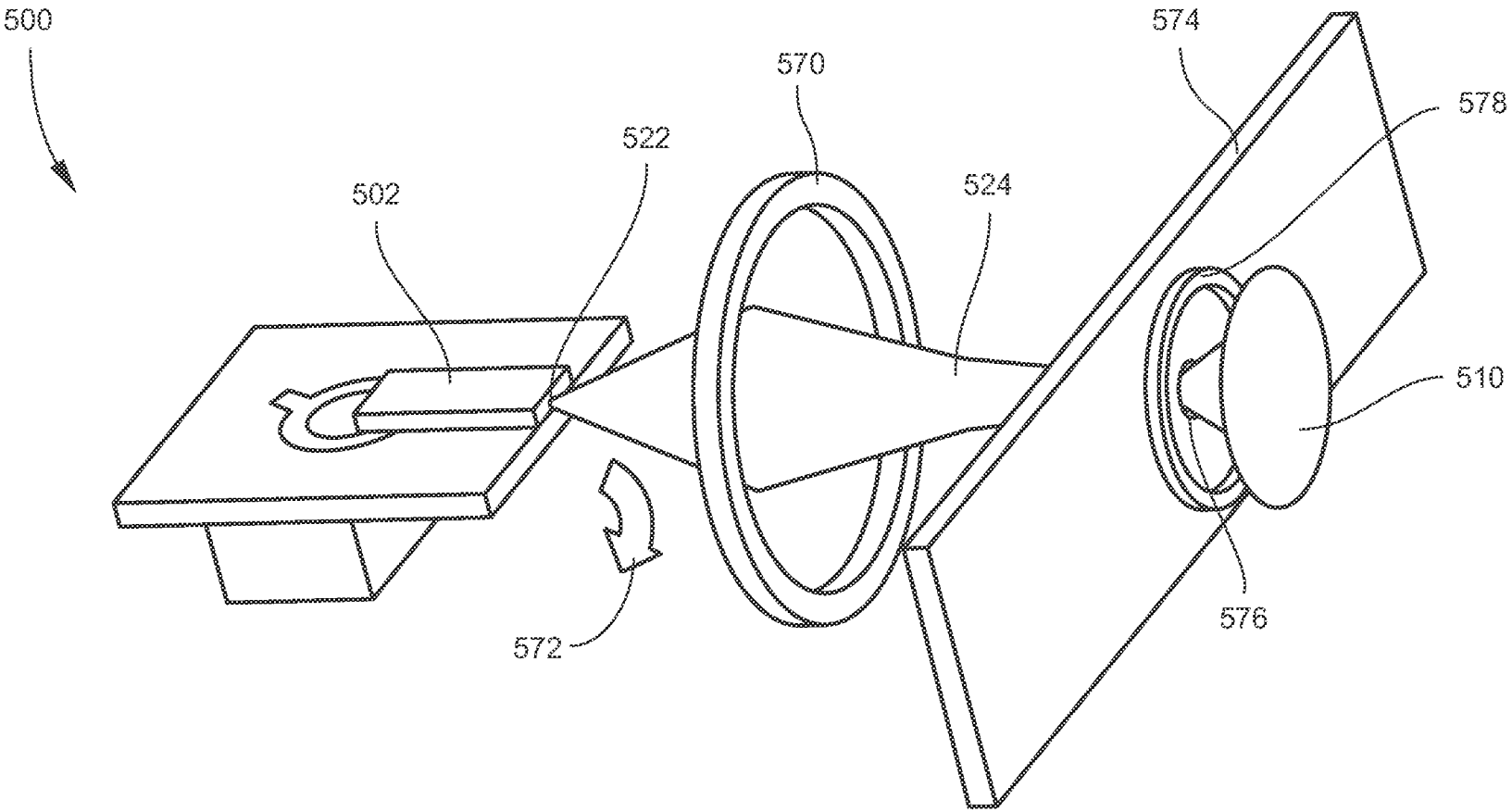
FIG. 5 is a perspective view of an example of an ECD apparatus according to another embodiment.

FIG. 5 is a perspective view of an example of an ECD apparatus 500 according to another embodiment, illustrating further examples of plasma refinement devices. The ECD apparatus 500 generally includes a plasma source 502 configured for generating plasma, and an ECD chamber (not specifically shown) configured for receiving an analyte ion beam (not specifically shown) in an ECD interaction region 510 containing the plasma. The plasma source 502 includes a plasma outlet 522 from which a plasma plume 524 is emitted. In some embodiments, the ECD apparatus 500 includes a plasma refinement device configured for guiding the plasma ions and electrons of the plasma plume 524 along a trajectory that other particles do not follow. For example, this type of device may be configured for applying a static magnetic field having a spatial orientation that confines the plasma ions and electrons along a nominal plasma flux axis directed to the ECD interaction region 510, such that the plasma flux occupies a tube or beam shape. In the illustrated embodiment, the magnetic device includes one or more magnets 570 arranged about the plasma flux axis between the plasma outlet 522 and the ECD interaction region 510, such as electromagnets or axially magnetized permanent magnets. The magnets 570 may be continuous rings or cylinders, or circumferentially spaced segments coaxial with the plasma flux axis.

With a sufficiently strong static magnetic field applied, plasma electrons are forced to follow spiral trajectories centered on the magnetic field lines. Due to the ambipolar electric field that exists due to the attractive electrostatic force felt between the plasma electrons and ions, the heavier plasma ions are forced to follow along the same magnetized trajectory, pulled along by the electrons. If the magnetic fields are even stronger, the plasma ions too will be heavily guided by the magnetic field, though this is not necessary for plasma guiding. While plasma ions are not a desirable species for ECD, their presence is beneficial to cancel out space-charge effects and thereby facilitate transporting a very high density of electrons to the ECD interaction region 510. Beneficially, plasma ions have very low temperatures when operating at low pressures (tenths of an eV), which is desirable to minimize collisional interactions with analyte ions. Because the other, undesired particles of the plasma plume are not charged (UV photons, metastable and unexcited neutrals) they ignore the magnetic field. Hence, the magnetic field is useful for guiding the plasma ions and electrons along the plasma flux axis to the ECD interaction region 510, while allowing the undesired particles to diffuse away from the plasma flux axis. Photons may be absorbed on inside surfaces in the ECD chamber, and metastable and unexcited neutrals may be pumped away as indicated by an arrow 572.

In some embodiments, the ECD apparatus includes one or more walls 574 (plates, baffles, etc.) positioned in the ECD chamber between the plasma outlet 522 and the ECD interaction region 510 to absorb photons and block neutrals, and thereby prevent these particles from entering the ECD interaction region 510. The wall 574 is particularly useful in conjunction with the magnetic field. The magnetic field may be arranged so that the plasma ions and electrons follow a trajectory that bypasses the wall 574 while the unguided photons and neutrals impinge upon the wall 574. Alternatively, as illustrated in FIG. 5, the wall 574 may include an orifice 576. The magnetic field may be arranged so that the plasma flux axis passes through the orifice 576, whereby mostly plasma ions and electrons are threaded through the orifice 576 and enter the ECD interaction region 510. The orifice 576 serves as a gas conductance barrier to neutral particles while the surrounding wall 574 serves as a plasma loss surface. In such embodiments as illustrated in FIG. 5, the ECD chamber may be considered as including a plasma refinement region between the plasma source 502 and the wall 574, and the ECD interaction region 510 on the other side of the wall 574.

In some embodiments, the magnetic device further includes a magnet 578 positioned at one or both sides of the wall 574 coaxial with the orifice 576. The magnet 578 may be an electromagnet that applies a magnetic field at a variable (adjustable) magnetic flux density. To concentrate plasma ions and electron at the orifice 576, this magnet 578 may be operated at a higher magnetic flux density than the magnet 570 utilized to capture the plasma plume 524 expanding out from the plasma outlet 522. Thus in this embodiment, as the plasma plume 524 (composed of hot plasma electrons, cool plasma ions, unexcited neutrals, metastables, and photons) is discharged from the plasma outlet 522, it begins to expand radially outward and also begins to undergo collisional cooling as described above. Simultaneously, the magnet 570 magnetically captures the plasma plume 524. In the expansion region the neutral density drops rapidly and consequently the collision rate drops. The degree to which the magnetic field is able to guide the plasma flux is inversely proportional to the local neutral density, because collisions with neutrals cause cross-field diffusion. With the magnetic flux density being higher at the magnet 578 located at the orifice 576 than the upstream magnet 570, the magnetic flux density increases as the plasma plume 524 travels forward, causing the plasma plume 524 to contract or converge toward the orifice 576 as schematically illustrated. The plasma plume 524 then threads through the orifice 576, on the other side of which is the ECD interaction region 510 where the analyte ions are passed through the plasma plume 524. Particles of the plasma plume 524 unaffected by the magnetic field continue to diverge as they travel toward the orifice 576. The particles in the portion of the plasma plume 524 incident on the wall 574 surrounding the orifice 576 are annihilated or blocked and pumped away. Consequently, very little UV photon, unexcited neutral, or metastable flux passes through the orifice 576 and into the interaction region 510.

If a particular electron density in the ECD interaction region 510 is desired, the magnetic field in the vicinity of the orifice 576 can be increased or decreased, which will change the fraction of plasma that threads through the orifice 576 and enters the interaction region 510. The stronger the magnetic field, the more plasma flux is threaded through the orifice 576. Hence, this embodiment provides a device for tuning the electron density in the interaction region 510 by controlling (adjusting) the electron density. The magnetic field may be adjusted by the power source communicating with the magnet 578 located at the orifice 576, which may in turn be controlled by any suitable controller that may be associated with the ECD apparatus 500, such as an electronic processor-based controller as appreciated by persons skilled in the art.

Tuning the electron density in the ECD interaction region 510 may be desirable to suppress secondary ECD, which may occur due to an overly dense population of electrons in the interaction region 510. That is, "primary" ECD fragment ions produced by primary ECD (i.e., the first generation of product ions produced directly from dissociation of the parent, or precursor, analyte ions supplied to the interaction region 510) may be further fragmented before passing out from the interaction region 510, thereby producing "secondary" ECD fragment ions. Primary ECD fragment ions that undergo secondary ECD are thus lost. In some applications it may be desirable to produce and analyze secondary ECD fragment ions. In other applications, however, the loss of primary ECD fragment ions is not desirable, because only primary ECD fragment ions are of interest and it is advantageous to produce as many primary ECD fragment ions as possible for the ion signal. This problem may be addressed by tuning the electron density as described above.

Additionally, the electron density in the ECD interaction region can be modulated by changing the input power to the plasma source (e.g., adjusting the energy source associated with the plasma source), changing the flow rate of the plasma-forming gas into the plasma source (e.g., adjusting the gas source or gas supply system), or a combination of the two. In general the plasma flux (and therefore the electron density in the ECD interaction region) varies directly and monotonically with the input power, and depending on the pressure regime the plasma is operating in, can increase or decrease with increasing plasma gas flow rate (or equivalently pressure). Depending on the configuration of the plasma source, modulating the plasma flux using these methods may be essentially linear in some ranges though not in general.

Alternatively or additionally, the plasma flux may also be tuned by means of pulse width modulation (PWM). That is, the energy source associated with the plasma source may be operated to effect plasma pulsing, i.e., alternately activating and deactivating the plasma, according to a desired PWM pulse wave. Plasma pulsing results in packets of plasma being discharged from the plasma source. In order to prevent large temporal fluctuations of the electron density in the ECD interaction region, the pulsing frequency should be sufficiently high so that the thermal dispersion of the packets of plasma that exit the plasma source region along the intervening distance is sufficient to cause the packets to overlap, presenting a time-averaged electron density in the ECD interaction region that is a function of pulse width. As such packets of plasma travel along a distance, the spread of velocities of plasma particles cause different particles to travel either slightly faster or slightly slower than the average drift velocity of the plasma flux. Effectively this represents a low-pass filter on the resulting electron density in the ECD interaction region. Provided the pulse width remains sufficiently longer than the rise time for plasma initiation at the start of each pulse, the plasma flux varies linearly with the duty cycle. For the plasma species temperatures (0.1 eV) and drift speeds ($1\times10^3$ m/s) of typical low-pressure plasma sources, and the intervening distances of typical instrumentation (several cm), the minimum pulsing frequency is on the order of 1 MHz. Such modulation frequencies are practical for microwave (GHz) plasma sources.

Figure 6:
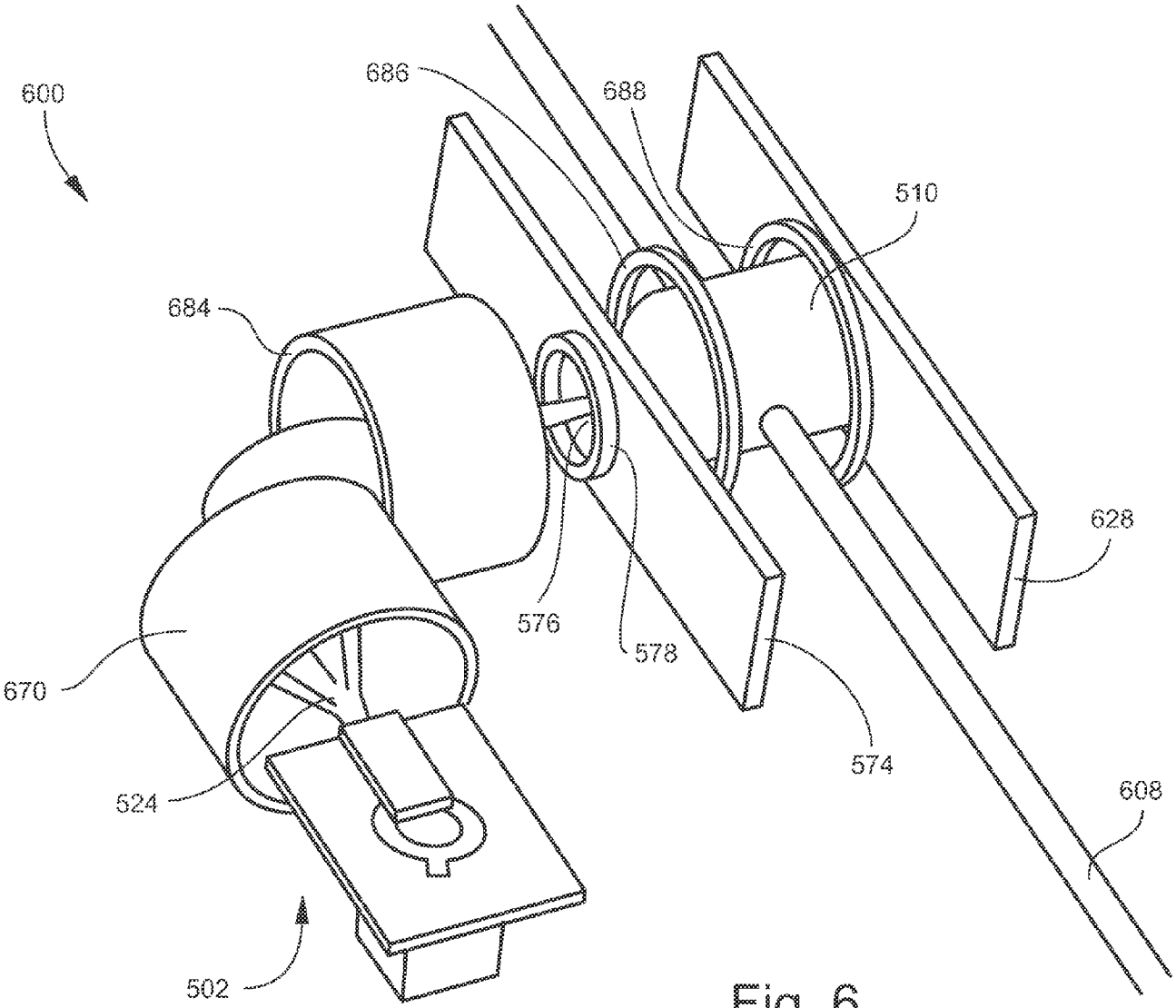
FIG. 6 is a perspective view of an example of an ECD apparatus according to another embodiment.

FIG. 6 is a perspective view of an example of an ECD apparatus 600 according to another embodiment, illustrating another example of a plasma refinement device. In this embodiment, the ECD apparatus 600 includes a device configured for confining plasma ions and electrons along a plasma flux axis or path that includes one or more bends or curves between the plasma outlet 522 and the ECD interaction region 510. That is, the plasma flux axis or path changes direction one or more times. As an example, the direction of the plasma flux out from the plasma outlet 522 may be different from direction of the plasma flux into the interaction region 510. The curvature in the plasma flux path may change the direction by ninety degrees as illustrated, but other angles may be implemented. The plasma refinement device may be configured for applying a curved static magnetic field. In the illustrated embodiment, the device includes a first magnet 670 and a second magnet 684 coaxially arranged about different axes. In operation, after the plasma plume 524 is emitted from the plasma outlet 522, all particles of the plasma plume 524 travel forward while diffusing outward. The plasma ions and electrons are confined by the curved magnetic field and consequently follow a curved path toward the interaction region 510. However, the particles unaffected by the magnetic field do not follow the curved path and instead continue to travel forward beyond the bend in the path, and thus do not reach the interaction region 510. Photons may be absorbed on inside surfaces in the ECD chamber, and metastable and unexcited neutrals may be pumped away.

As illustrated in FIG. 6, in some embodiments the wall 574 may be provided in front of the interaction region 510 as described above, with the orifice 576 centered on the plasma flux axis. Additionally, in some embodiments the variable-strength magnet 578 coaxial with the orifice 576 may be provided on one or both sides of the wall 574 to enable tuning of the electron density as described above.

In the embodiment illustrated in FIG. 6, the ECD interaction region 510 is located between the wall 574 with the orifice 576 and a termination wall 628. It is desirable to send an entire analyte ion beam 608 through a region of the plasma in the interaction region 510 where all analyte ions in the beam 608 encounter approximately the same integral number of electrons (electron density) and electron temperature along the beam path through the plasma. In other words, it is desirable to direct the analyte ion beam 608 through an electron field that is as homogeneous as possible. If some ions pass through regions that are much denser than other regions through which other ions pass, some of the ions may be either under-fragmented or over-fragmented. To this end, the ECD apparatus 600 may include a device configured for homogenizing the electron field (i.e., rendering the electron density uniform) in the interaction region 510. In some embodiments, the device may be configured for applying a static magnetic field of substantially uniform magnetic flux density to the plasma plume 524 in the interaction region 510. For example, the device may include a magnet assembly of two or more magnets 686 and 688 (permanent magnets or electromagnets), which may be arranged as a Helmholtz coil as illustrated, or as a Maxwell coil. The magnetic field limits the trajectories of the plasma ions and electrons such that they occupy a tube or beam shape. This magnetic field may be weaker than that applied by the magnet 578 located at the orifice 576, thereby allowing the plasma plume 524 emerging from the orifice 576 to expand in the interaction region 510. Consequently, as schematically illustrated in FIG. 6, the diameter of the plasma plume 524 confined in the interaction region 510 is larger than the diameter of the analyte ion beam 608 so that all analyte ions encounter essentially the same integral number of electrons. The relatively weak magnetic field should not affect the trajectory of the ion beam 608 to any significant extent.

In another embodiment, a variable mechanical aperture or shutter (not shown) may be provided for tuning the electron density. The mechanical aperture may be positioned at a wall between the plasma source 502 and the ECD interaction region 510. The size of the aperture is adjustable by mechanical movements as appreciated by persons skilled in the art. By this configuration, the plasma flux is guided through the aperture and electron density is tuned by adjusting the aperture.

It can be seen that some embodiments described herein provide plasma refinement (or tuning) devices configured for refining or tuning plasma after the plasma has been emitted from the plasma source as a plasma plume. That is, such devices are configured for refining or tuning the plasma plume outside the plasma source. Such devices may be referred to as ex situ devices. Other embodiments provide plasma refinement (or tuning) devices configured for converting the plasma generated in the plasma source to refined or tuned plasma before the plasma is emitted from the plasma source. In these other embodiments, the plasma emerging from the plasma source as a plasma plume is already refined or tuned. Such devices may be referred to as in situ devices. An ECD apparatus as described herein may include one or more different types of in situ devices only, one or more different types of ex situ devices only, or a combination of one or more different types of in situ devices and ex situ devices.

As one example of in situ plasma tuning, the ECD apparatus may include a device configured for pulsing the plasma in the plasma source, i.e., cycling the plasma source between activating (exciting) and deactivating (de-exciting) the plasma in the source interior. Referring back to FIG. 1, the energy source 118 may be cycled between an energized (ON) state during which the energy source 118 is operated to sustain the plasma in the normal manner, and a de-energized (OFF) state during which the energy source 118 is not actively sustaining the plasma. This pulsing or cycling may be controlled by any suitable controller that may be associated with the ECD apparatus 100, such as an electronic processor-based controller as appreciated by persons skilled in the art. Thus the energy source 118, or the energy source 118 and a controller communicating with the energy source 118, may be considered as an in situ plasma refining or tuning device.

Figure 7:
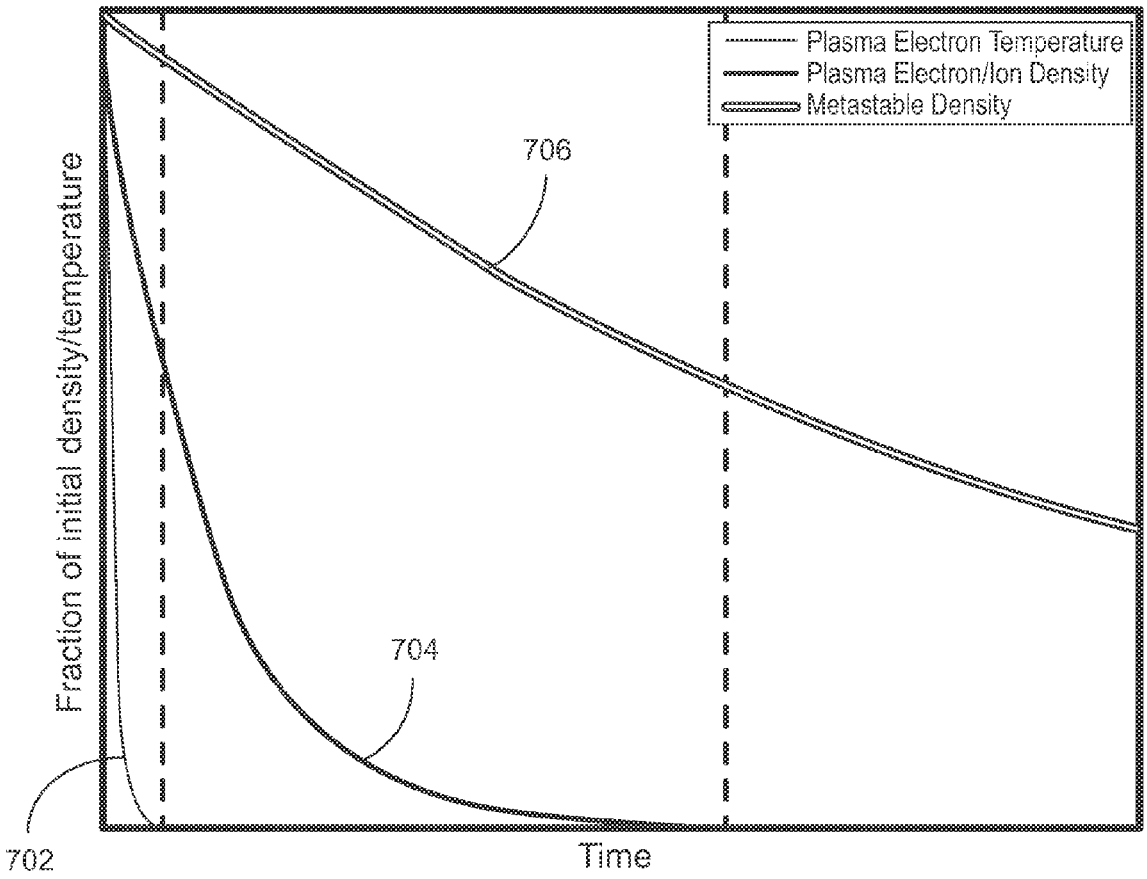
FIG. 7 is a set of plots comparing the temporal evolution of plasma electron temperature and plasma electron/ion density as well as metastable density, in the afterglow of a plasma.

Pulsing the plasma may be utilized to tailor both the electron temperature and density. When the power to a plasma is turned off (resulting in a so-called "afterglow"), the highly mobile electrons attempt to quickly exit the volume. In a low-pressure plasma the primary force acting against this diffusion is the attractive ambipolar electric field present as a result of a high density of less mobile positive plasma ions. The high-energy electrons in the tail of the distribution are the first to escape, which results in an extremely rapid cooling of the electron population. This electron cooling process is much faster than the rate by which overall electron density drops, which is limited by ambipolar diffusion. This is illustrated in FIG. 7, which is a set of simulated plots comparing the approximate temporal evolution of plasma electron temperature (curve 702) and plasma electron/ion density (curve 704), as well as metastable density (curve 706) in the afterglow of a plasma. Time t=0 corresponds to the time of plasma shutoff. As noted, in the afterglow the high-energy electrons diffuse away first, followed by the low-energy electrons and plasma ions. Metastables diffuse at a much slower rate and are the last of the excited species to remain in the afterglow, followed by unexcited neutrals. Besides the high-energy electrons, UV photons also diffuse extremely rapidly as they propagate at the speed of light. Additionally, the production of UV photons drops off very quickly because the primary mechanism for producing photons is collisions between the rapidly escaping high-energy electrons and neutral atoms.

Pulsing the plasma thus results in periods of time during which the plasma in the ECD interaction region 110 is primarily an afterglow characterized by containing a population of low-energy electrons conducive to ECD and an absence or negligible amount of high-energy electrons. The ON/OFF plasma pulsing may be synchronized with the timing of one or more other operations of the MS system associated with the ECD apparatus 100 so that the MS measures only those analyte ion fragments that were produced after the high-energy electrons had already diffused away from the plasma flux, i.e., only those analyte ion fragments that were the result of ECD from low-energy electrons. As one example, the analyte ion beam 108 may be gated (pulsed) upstream of the ECD apparatus 100, and the timing of the gating operation may be synchronized with the timing of the plasma pulsing. In this way, the analyte ion beam may be admitted into the ECD apparatus 100 only when a negligible amount of high-energy electrons are present in the interaction region. As another example, the analyte (fragment) ion beam may be gated (pulsed) downstream of the ECD apparatus 100, again with the timing of the gating synchronized with the timing of the plasma pulsing. In this way, fragment ions produced only as a result of ECD from low-energy electrons may be transferred into the mass analyzer, with all other ions being rejected and thus not contributing to the mass spectra. Embodiments of MS systems implementing plasma pulsing are described by example below.

Further, an overabundance of even just low-energy electrons in the interaction region may lead to secondary ECD, which may be undesirable as noted above. This problem likewise may be addressed by synchronizing plasma pulsing with other instrument/system operations. It is observed that in the plasma afterglow, after the density of high-energy electrons becomes negligible, the density of the low-energy electrons continues to decay with further passage of time (before the plasma is reactivated by the plasma source) 102. Thus, plasma pulsing as described above may be utilized to avoid the measurement of secondary ECD fragment ions, either by gating the analyte ion beam upstream of the ECD apparatus 100 to avoid the production of secondary ECD fragment ions, or by gating the analyte ion beam downstream to avoid transferring secondary ECD fragment ions into the mass analyzer. This may be achieved by coordinating plasma pulsing with other instrument/system operations, based on the time of interaction between the parent analyte ions and the afterglow when the afterglow is composed of a lower density of low-energy electrons as well as a negligible density or absence of high-energy electrons.

As another example, the gas supply system 120 shown in FIG. 1, or the gas supply system 120 and a controller communicating with gas supply system 120, may be configured as an in situ plasma refining or tuning device. The gas supply system 120 may include two or more sources 192 of different plasma-forming gases. The plasma-forming gas has a strong effect on the electron temperature. The steady-state electron temperature of helium plasma, for example, is much higher than for other noble gases (e.g. argon, krypton, or xenon). The reason for this is that the electron temperature represents a balance of electromagnetic energy input into the plasma through coupling to free electrons, and energy loss processes, in particular through collisions that ionize or excite neutral particles. Helium energy levels are substantially higher than for other gases. The lowest excitation level is the 19.8 eV metastable level, and its ionization potential is 24.6 eV. These levels are much higher than for example argon, whose lowest excitation level is 11.6 eV and whose ionization potential is 15.8 eV. Electrons in helium plasma exhibit higher temperatures (typically 7 or more eV) compared with argon plasmas (typically 2 or more eV) because they can rise to higher energies before they excite or ionize atoms in the plasma and lose their energy. This phenomenon therefore can be used as a means to tailor the electron temperature by operating the gas supply system 120 to select a particular gas, or mixture of gases and their relative proportions, for use in forming plasma in the plasma source 102.

The gas supply system 120 may further include one or more sources 194 of quenching gas. When a mixture of more than one gas is used, the gas species that exhibits the lowest energy is dominantly excited and ionized compared with the higher-energy species. This is true for electron collisions as well as for collisions between metastable atoms of the higher-energy species and atoms or molecules of the lower-energy species. Small additions of a lower-energy species, for example nitrogen, can provide a mechanism by which high-energy metastables can be quenched through collisions that dissociate or ionize the lower-energy species. Undesired metastable atoms can therefore be minimized through small admixtures of a quenching gas. An additional effect of such a quenching gas is to enhance the cooling of the electrons, which typically lose a larger fraction of their energy in inelastic collisions with quenching gas molecules compared with elastic scattering collisions.

In embodiments described thus far, the ECD interaction region is located outside the plasma source. In other embodiments, the ECD interaction region may be located inside the plasma source, i.e., plasma generation and ECD interaction between the generated plasma and the analyte ion beam may both occur in the source interior. In such embodiments, all or part of the source interior serves as the ECD chamber. Referring to FIG. 1 for illustrative purposes, the plasma source 102 and other components of the ECD apparatus 100 may be modified so that the analyte ion beam 108 is directed through an ion inlet (not shown) of the plasma source 102 and into the source interior 114. Fragment ions may exit the plasma source 102 through the plasma outlet 122 and guided to a downstream module of an associated MS system by appropriate ion optics. Alternatively, the plasma source 102 may be modified to provide an ion outlet separate from the plasma outlet 122. In either case, the chamber 104 illustrated in FIG. 1 may serve as a pressure-reducing interface with a downstream module. Analyte ions may be directed through the active plasma. Alternatively or additionally, plasma pulsing may be implemented and analyte ions may be directed through the afterglow of the plasma. As described above, the analyte ion beam may be gated or pulsed upstream of the ECD apparatus in a manner coordinated with a selected point in time during the evolution of the composition of the afterglow, or may be gated or pulsed downstream of the ECD apparatus 100 in a manner that isolates the ECD-produced ions for analysis. The configuration (e.g., size, structure, geometry) of the source interior 114 may be modified as needed to facilitate both plasma generation and ECD interaction, and as well as the implementation of one or more of the plasma refinement and tuning methods disclosed herein.

Figure 8:
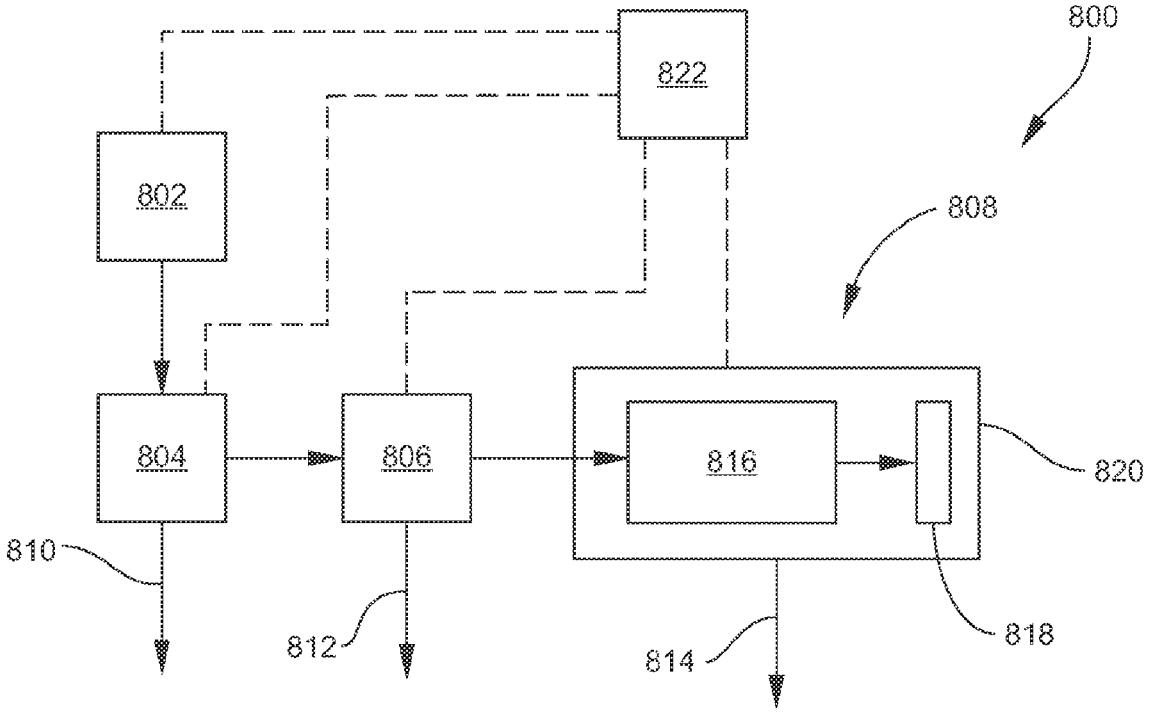
FIG. 8 is a schematic view of an example of a mass spectrometry (MS) system according to some embodiments.

FIG. 8 is a schematic view of an example of a mass spectrometry (MS) system 800 according to some embodiments. The MS system 800 generally includes a sample source 802, an analyte ion source (or ionization apparatus) 804, an ECD apparatus 806, a mass spectrometer (MS) 808, and a vacuum system for maintaining the interiors of the ECD apparatus 806 and MS 808 (and in some embodiments the interior of the ion source 804) at controlled, sub-atmospheric pressure levels, and for removing non-analytical neutral particles from the MS system 800. The vacuum system is schematically depicted by vacuum lines 810, 812 and 814 leading from the ion source 804, ECD apparatus 806, and MS 808, respectively. The vacuum lines 810, 812 and 814 are schematically representative of one or more vacuum-generating pumps and associated plumbing and other components as appreciated by persons skilled in the art. The structure and operation of various types of sample sources, MSs, and associated components are generally understood by persons skilled in the art, and thus will be described only briefly as necessary for understanding the presently disclosed subject matter. In practice, the ion source 804 and ECD apparatus 806 may be integrated with the MS 808 or otherwise considered as the front end or inlet of the MS 808, and thus in some embodiments may be considered as components of the MS 808.

The sample source 802 may be any device or system for supplying a sample to be analyzed to the ion source 804. The sample may be provided in a liquid- or gas-phase (or vapor) form that flows from the sample source 802 into the ion source 804. In hyphenated systems such as liquid chromatography-mass spectrometry (LC-MS) or gas chromatography-mass spectrometry (GC-MS) systems, the sample source 802 may be an LC or GC system, in which case an analytical column of the LC or GC system is interfaced with the ion source 804 through suitable hardware. The pressure in the sample source 802 is typically around atmospheric pressure (around 760 Torr) or at a somewhat sub-atmospheric pressure. Alternatively, the sample source 802 may be a solid target loaded into the ion source 804 when, for example, the ion source 804 is configured for implementing a technique based on laser desorption/ionization.

Generally, the ion source 804 is configured for producing analyte ions from a sample provided by the sample source 802 and directing the as-produced ions into the ECD apparatus 806. In typical embodiments where ionization is followed by ECD, the ion source 804 is an electrospray ionization (ESI) apparatus. In other embodiments, the ion source 804 may be configured for matrix-assisted laser desorption ionization (MALDI) or matrix-assisted laser desorption electrospray ionization (MALDESI). More generally, however, the ion source 804 may be configured for carrying out any atmospheric-pressure or vacuum ionization technique compatible with the ECD apparatus 806 and methods disclosed herein. Thus, the internal pressure of the ion source 804 is generally not limited, but rather may range from atmospheric pressure down to a sub-atmospheric or vacuum-level pressure. The internal pressure of the ion source 804 may be higher than or about the same as the internal pressure of the ECD apparatus 806.

The analyte ions produced by ion source 804 may be focused as an analyte ion beam and transferred to the ECD apparatus 806 by suitable ion optics (not shown). The ECD apparatus 806 may be configured according to any of the embodiments disclosed herein. The operating pressure of the ECD apparatus 806 is typically higher than the very low vacuum pressure inside the MS 808. In some embodiments, the operating pressure of the ECD chamber is in a range from 0.001 Torr to 0.1 Torr. The operating pressure of the plasma source of the ECD apparatus 806 may be in a range from 0.1 Torr to 10 Torr. Fragment ions (and non-dissociated parent ions) produced by the ECD apparatus 806 may be focused and transferred to the MS 808 by suitable ion optics (not shown).

The MS 808 may generally include a mass analyzer 816 and an ion detector 818 enclosed in a housing 820. The vacuum line 814 maintains the interior of the mass analyzer 816 at very low (vacuum) pressure. In some embodiments, the mass analyzer 816 pressure ranges from $10^{-4}$ to $10^{-9}$ Torr. The mass analyzer 816 may be any device configured for separating, sorting or filtering analyte ions on the basis of their respective m/z ratios. Examples of mass analyzers include, but are not limited to, multipole electrode structures (e.g., quadrupole mass filters, linear ion traps, three-dimensional Paul traps, etc.), time-of-flight (TOF) analyzers, electrostatic traps (e.g. Kingdon, Knight and ORBITRAP® traps) and ion cyclotron resonance (ICR) traps (FT-ICR or FTMS, also known as Penning traps). The ion detector 818 may be any device configured for collecting and measuring the flux (or current) of mass-discriminated ions outputted from the mass analyzer 816. Examples of ion detectors 818 include, but are not limited to, image current detectors, electron multipliers, photomultipliers, Faraday cups, and micro-channel plate (MCP) detectors.

The MS system 800 may further include a system controller 822, which is schematically depicted in FIG. 8 as representing one or more modules configured for controlling, monitoring and/or timing various functional aspects of the MS system 800 such as, for example, controlling the operations of the sample source 802; the ionization apparatus 804; the ECD apparatus 806, including any plasma refinement and/or tuning devices provided; and the MS 808; as well as controlling various gas flow rates, temperature and pressure conditions, and any other ion processing components provided between the illustrated devices. The system controller 822 may also be configured for implementing plasma pulsing and synchronizing plasma pulsing with gating of the analyte ion beam as described herein. The system controller 822 may also be configured for receiving the ion detection signals from the ion detector 818 and performing other tasks relating to data acquisition and signal analysis as necessary to generate a mass spectrum characterizing the sample under analysis. The system controller 822 may include a computer-readable medium that includes instructions for performing any of the methods disclosed herein. For all such purposes, the system controller 822 is schematically illustrated as being in signal communication with various components of the MS system 800 via wired or wireless communication links represented by dashed lines.

It will be understood that FIG. 8 is a high-level schematic depiction of the MS system 800 disclosed herein. As appreciated by persons skilled in the art, other components, such as additional structures, ion optics, ion guides, mass filters, collision cells, ion traps, and electronics may be included needed for practical implementations, depending on how the MS system is to be configured for a given application.

Figure 9:
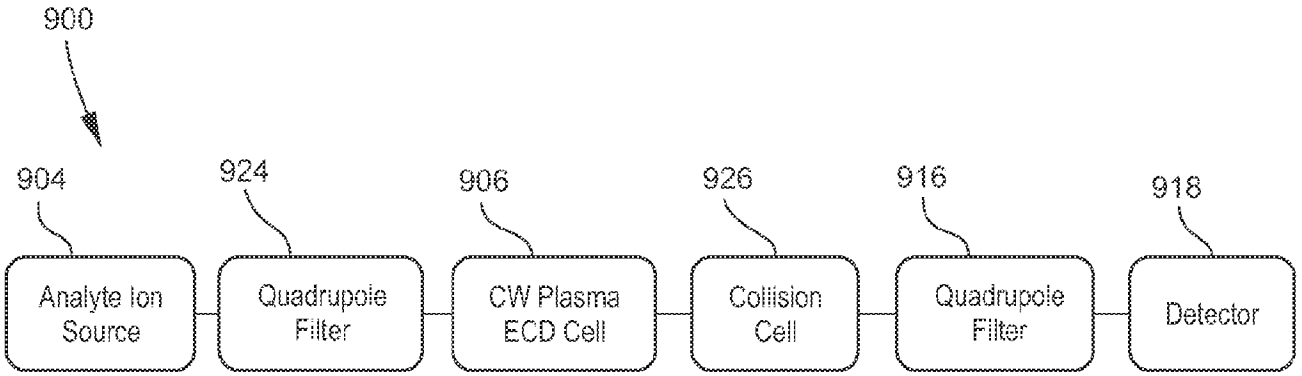
FIG. 9 is a schematic view of an example of an MS system according to some embodiments in which the MS system includes a continuous wave (CW) plasma ECD apparatus and is based on a triple quad (QQQ) configuration.

FIG. 9 is a schematic view of an example of an MS system 900 according to some embodiments in which the MS system 900 includes a continuous wave (CW) plasma ECD apparatus (PECD apparatus) 906 and is based on a triple quad (QQQ) configuration. The MS system 900 includes, in order of ion processing flow, an analyte ion source 904, a first mass filter 924, the PECD apparatus 906, optionally a collision cell 926, and an MS including a second mass filter 916 and a detector 918. The first mass filter 924 and second mass filter 916 may be configured as linear multipole (e.g., quadrupole) instruments that apply a composite RF/DC electric field with parameters effective for mass filtering ions. In some embodiments, the collision cell 926 is included between the PECD apparatus 906 and the second quadrupole mass filter 916. The collision cell 926 may have any configuration suitable for performing collision-induced dissociation (CID) as a fragmentation mechanism complementary to ECD. In some embodiments, the collision cell 926 is configured as an RF-only multipole ion guide enclosed in a chamber in which an inert collision gas is introduced under conditions effective for CID.

In operation, the first mass filter 924 receives (parent) analyte ions produced in the ion source 904 and allows only those analyte ions having a selected mass-to-charge (m/z) ratio to be transferred to the PECD apparatus 906. The PECD apparatus 906 produces fragment ions as described above and the fragment ions (or mixture of fragment ions and intact parent ions) are transferred to the second quadrupole mass filter 916. Alternatively, the fragment ions are transferred to the collision cell 926 where further fragmentation occurs by CID. The second mass filter 916 receives the fragment ions from the PECD apparatus 906 (or from the collision cell 926 when provided) and allows only those fragment ions having a selected mass-to-charge (m/z) ratio to pass through and impact the detector. 918

The MS system 900 may be operated without inducing CID while the collision cell 926 is installed. In this case the collision cell 926 may be operated at a lower pressure as a linear ion guide, or further as an ion beam cooler with the (lower pressure) collision gas functioning as a damping gas.

In other embodiments, a linear multipole ion trap, a three-dimensional Paul trap, electrostatic trap or a Penning trap-based instrument such as a Fourier transform ion cyclotron resonance (FT-ICR) MS may be substituted for the second mass filter 916.

Figure 10:
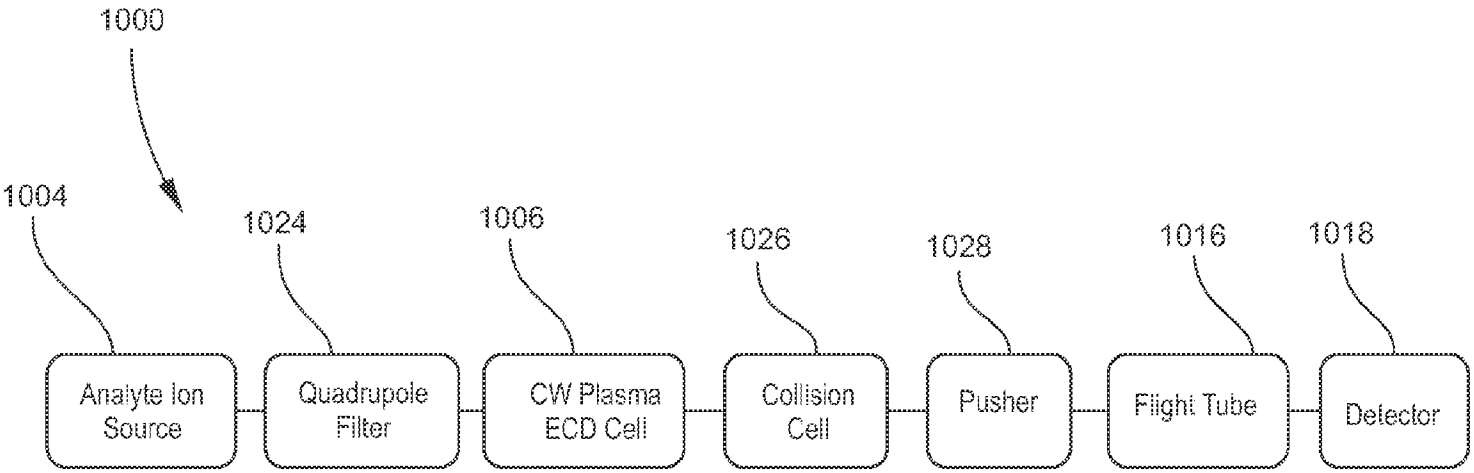
FIG. 10 is a schematic view of an example of an MS system according to some embodiments in which the MS system includes a CW plasma ECD apparatus and is based on a quadrupole time-of-flight (QTOF) configuration.

FIG. 10 is a schematic view of an example of an MS system 1000 according to some embodiments in which the MS system 1000 includes a CW plasma ECD apparatus (PECD apparatus) 1006 and is based on a quadrupole time-of-flight (QTOF) configuration. The MS system 1000 includes, in order of ion processing flow, an analyte ion source 1004, a mass filter 1024, the PECD apparatus 1006, optionally a collision cell 1026, and a time-of-flight (TOF) MS including a high-voltage ion accelerator 1028, a flight tube 1016, and a detector 1018. The mass filter 1024 and collision cell 1026 may be configured as described above in conjunction with FIG. 9. In this embodiment, the ion accelerator 1028 (e.g., an ion pusher or puller) accelerates fragment ions into the flight tube 1016 as ion packets according to a desired pulse rate. The TOF MS may be either orthogonal or on-axis. The operation of the MS system 1000 may otherwise be similar that described above in conjunction with FIG. 9.

Figure 11:
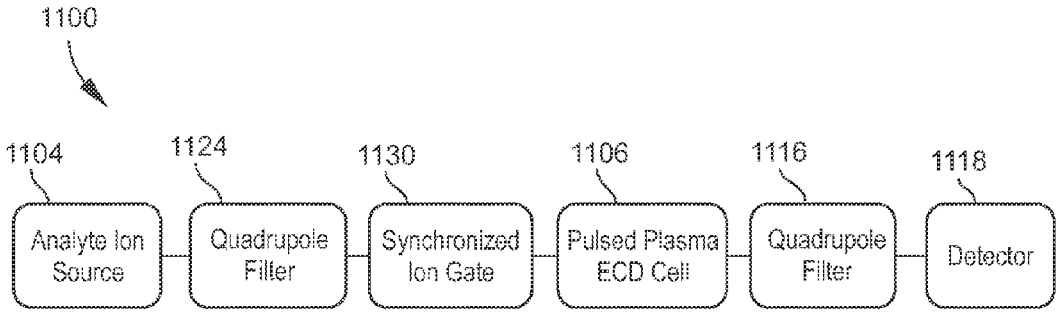
FIG. 11 is a schematic view of an example of an MS system according to some embodiments in which the MS system includes a pulsed plasma ECD apparatus and is based on a triple quad (QQQ) configuration.
Figure 12:
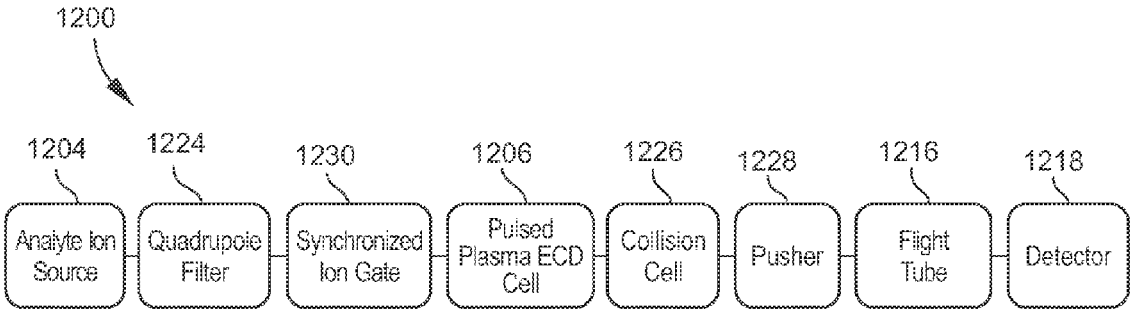
FIG. 12 is a schematic view of an example of an MS system according to some embodiments in which the MS system includes a pulsed plasma ECD apparatus and is based on a QTOF configuration.
Figure 13:
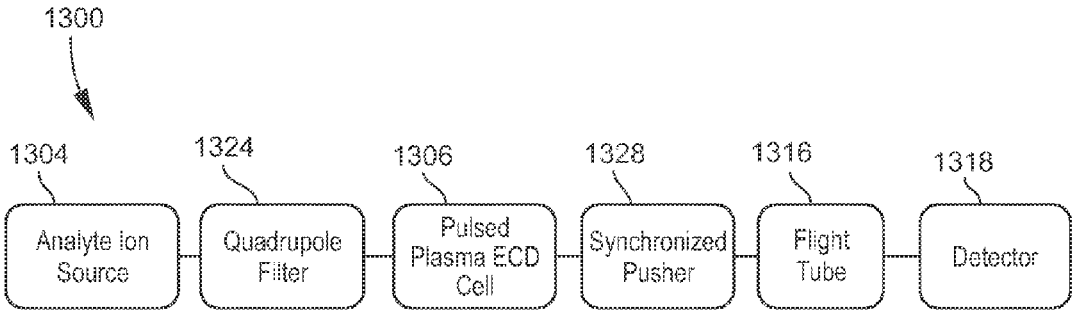
FIG. 13 is a schematic view of another example of an MS system according to some embodiments in which the MS system includes a pulsed plasma ECD apparatus and is based on a QTOF configuration.

FIGS. 11 to 13 illustrate non-limiting examples of MS systems that implement pulsed plasma ECD (PPECD). As described above, an advantage of using a pulsed plasma source to perform ECD is that two particle species that can cause unwanted ionization and fragmentation, high-energy electrons and UV photons, rapidly decay in the afterglow of a plasma after excitation is stopped, on a time scale much faster than the rate at which the low-energy electron density decays. In a non-pulsed ECD cell these particles must be removed from the plasma using other methods as described above.

FIG. 11 is a schematic view of an example of an MS system 1100 according to some embodiments in which the MS system 1100 includes a pulsed plasma ECD apparatus (PPECD apparatus) 1106 and is based on a triple quad (QQQ) configuration. The MS system 1100 includes, in order of ion processing flow, an analyte ion source 1104, a first mass filter 1124, an ion gate 1130, the PPECD apparatus 1106, and an MS including a second mass filter 1116 and a detector 1118. The first mass filter 1116 and second mass filter 1118 may be configured as described above in conjunction with FIG. 9. The ion gate 1130 may have any configuration suitable for switching between passing ions and rejecting ions pursuant to a desired duty cycle. For example, the ion gate 1130 may be an electrostatic lens or system of lenses. In this embodiment, the ion gate 1130 and PPECD apparatus 1106 replace the collision cell in a traditional QQQ system. Non-limiting examples of ion gates are described in U.S. patent application Ser. No. 13/840,898, titled "CONTROLLING ION FLUX INTO TIME-OF-FLIGHT MASS SPECTROMETERS," filed Mar. 15, 2013, the content of which is incorporated herein by reference.

In operation, analyte molecules are ionized and then filtered through the mass filter 1124 to select a single parent ion m/z ratio. These parent ions are then sent through the ion gate 1130. The ion gate 1130 is operated to periodically reject ions, essentially forming a pulse train of ions with a particular frequency and duty cycle. Following the ion gate 1130, the ions pass through the PPECD apparatus 1106 in which, as described above, they either pass through a plasma source region (where electric or electromagnetic energy is applied to the plasma) or a "plume" region where a plasma flux has passed out of the plasma source region. In the afterglow of the pulsed plasma, the electron population cools rapidly while dropping in density at a much slower rate. UV photons are also rapidly lost. The timing of the ion gate 1130 is synchronized with the plasma pulsing, such that the ion gate 1130 allows parent ions to enter the PPECD apparatus 1106 only after the electrons have cooled but before the next excitation pulse. If the ion gate 1130 were not employed, some parent ions would pass through the active plasma and experience other ionization and fragmentation events from exposure to high-energy electrons, UV photons, and metastable neutrals. After passing through the PPECD apparatus 1106 the fragment ions then pass through the second mass filter 1116 and then are finally incident on the detector 1118.

FIG. 12 is a schematic view of an example of an MS system 1200 according to some embodiments in which the MS system 1200 includes a pulsed plasma ECD apparatus (PPECD apparatus) 1206 and is based on a QTOF configuration. The MS system 1200 includes, in order of ion processing flow, an analyte ion source 1204, a mass filter 1224, an ion gate 1230, the PPECD apparatus 1206, an ion beam cooler 1226, and a time-of-flight (TOF) MS including a high-voltage ion accelerator 1228, a flight tube 1216, and a detector 1218. The mass filter 1224 may be configured as described above in conjunction with FIG. 9. The ion gate 1230 may be configured as described above in conjunction with FIG. 11. In a typical embodiment, the ion beam cooler 1226 is configured as an RF-only multipole ion guide enclosed in a chamber in which an inert damping gas is introduced. Hence, the ion beam cooler 1226 may be a collision cell operated not for fragmenting analyte ions but only for cooling the ion beam, as described above in conjunction with FIG. 9. The TOF MS may operate as described above in conjunction with FIG. 10.

In operation, analyte molecules are ionized and then filtered through the mass filter 1224 to select a single parent ion m/z ratio, and these parent ions are then sent through the ion gate 1230, as described above in conjunction with FIG. 11. As also described above, the timing of the ion gate 1230 is synchronized with the plasma pulsing, such that the ion gate 1230 allows parent ions to enter the PPECD apparatus 1206 only after the electrons have cooled but before the next excitation pulse. After passing through the PPECD apparatus 1206 the fragment ions then pass through the ion beam cooler 1226, which acts as a low-pass filter to remove the high-frequency variation in the ion beam as a result of the PPECD interaction. The ion beam is then sent to the accelerator 1228 which, as described above, accelerates ions from the ion beam in pulsed packets into the flight tube 1216 toward the detector 1218.

FIG. 13 is a schematic view of another example of an MS system 1300 according to some embodiments in which the MS system 1300 includes a pulsed plasma ECD apparatus (PPECD apparatus) 1306 and is based on a QTOF configuration. The MS system 1300 includes, in order of ion processing flow, an analyte ion source 1304, a mass filter 1324, the PPECD apparatus 1306, and a time-of-flight (TOF) MS including a high-voltage ion accelerator 1328, a flight tube 1316, and a detector 1318. In this embodiment, a synchronized ion gate is not employed. Instead, all parent ions are passed through the PPECD apparatus 1306, even during times when energy is being applied to the plasma and thus high energy electrons, UV photons, and metastables are present in large quantities. In contrast to the embodiment of FIG. 12, the timing of the accelerator 1328 is synchronized with the plasma pulsing. By this configuration, the accelerator 1328 acts as a filter, rejecting fragment ions that are the result of active plasma exposure, and only accelerating fragment ions that result from ECD interactions into the flight tube 1316 for mass analysis. The TOF MS may otherwise operate as described above in conjunction with FIG. 10.

Apart from the ECD apparatuses disclosed herein and the ways they are interfaced and cooperate with other devices of an MS system, the structure and operating principles of the other devices illustrated in FIGS. 9 to 13 are generally understood by persons skilled in the art, and thus have been described only briefly as necessary for understanding the presently disclosed subject matter.

It will be understood that the system controller 822 schematically depicted in FIG. 8 may include one or more types of hardware, firmware and/or software, as well as one or more memories and databases. The system controller 822 typically includes a main electronic processor providing overall control, and may include one or more electronic processors configured for dedicated control operations or specific signal processing tasks. The system controller 822 may also schematically represent all voltage sources not specifically shown, as well as timing controllers, clocks, frequency/waveform generators and the like as needed for operating the various components of the MS system 800. The system controller 822 may also be representative of one or more types of user interface devices, such as user input devices (e.g., keypad, touch screen, mouse, and the like), user output devices (e.g., display screen, printer, visual indicators or alerts, audible indicators or alerts, and the like), a graphical user interface (GUI) controlled by software, and devices for loading media readable by the electronic processor (e.g., logic instructions embodied in software, data, and the like). The system controller 822 may include an operating system (e.g., Microsoft Windows® software) for controlling and managing various functions of the system controller 822.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the system controller 822 schematically depicted in FIG. 8. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the system controller 822 in FIG. 8), direct the electronic system to carry out the instructions. The computer program product may be selectively embodied in any non-transitory computer-readable storage medium for use by or in connection with an instruction execution system, apparatus, or device, such as an electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program can be electronically captured via, for instance, optical scanning of the paper or other medium, then compiled, interpreted, or otherwise processed in a suitable manner if necessary, and then stored in a computer memory or machine memory.

Exemplary Embodiments

Exemplary embodiments provided in accordance with the presently disclosed subject matter include, but are not limited to, the following:

1. An electron capture dissociation (ECD) apparatus, comprising: a plasma source configured for generating plasma; a plasma refinement device configured for converting the generated plasma to refined plasma comprising predominantly low-energy electrons suitable for ECD and plasma ions; and a chamber configured for receiving an ion beam in an interaction region containing the refined plasma.

2. The ECD apparatus of embodiment 1, wherein the plasma refinement device is configured for removing plasma species from the plasma, and the plasma species are selected from the group consisting of: photons, metastable particles, neutral particles, high-energy electrons unsuitable for ECD; and a combination of two or more of the foregoing.

3. The ECD apparatus of embodiment 1 or 2, wherein the plasma refinement device is configured for controlling a density of the low-energy electrons in the plasma.

4. The ECD apparatus of embodiment 3, wherein the plasma source comprises an energy source configured for applying energy to the plasma in the plasma source, and the plasma refinement device has a configuration selected from the group consisting of: the plasma refinement device is configured for adjusting the power at which the energy is applied to the plasma; the plasma refinement device is configured for adjusting the flow rate of plasma-forming gas into the plasma source; the plasma refinement device is configured for applying energy to the plasma according to a pulse-width modulated pulse wave; and a combination of two or more of the foregoing.

5. The ECD apparatus of any of embodiments 1 to 4, wherein the plasma source comprises a housing enclosing the chamber, an inlet for admitting the ion beam into the chamber, and an outlet for outputting fragment ions from the chamber, and wherein the plasma refinement device is configured for converting the generated plasma to refined plasma in the chamber.

6. The ECD apparatus of any of embodiments 1 to 4, wherein the chamber is outside the plasma source, and the plasma source comprises a plasma outlet for emitting a plasma plume toward the chamber.

7. The ECD apparatus of embodiment 6, wherein the plasma refinement device has a configuration selected from the group consisting of: the plasma refinement device is configured for converting the generated plasma to refined plasma in the plasma source, wherein the plasma plume comprises refined plasma; the plasma refinement device is configured for refining the plasma of the emitted plasma plume; and the plasma refinement device is configured for converting the generated plasma to refined plasma in the plasma source, wherein the plasma plume comprises refined plasma, and the plasma refinement device is configured for further refining the plasma of the emitted plasma plume.

8. The ECD apparatus of embodiment 6 or 7, wherein the chamber comprises an ion guide configured for confining the ion beam to an axis directed to the interaction region.

9. The ECD apparatus of embodiment 8, wherein the ion guide is selected from the group consisting of: an electrostatic lens; a radio frequency confining device; a magnetic confining device; and a combination of two or more of the foregoing.

10. The ECD apparatus of embodiment 8 or 9, comprising a gas conduit positioned to introduce a damping gas into the ion guide.

11. The ECD apparatus of any of embodiments 6 to 10, wherein the plasma source comprises a plurality of plasma outlets arranged to direct a plurality of respective plasma plumes to the interaction region.

12. The ECD apparatus of any of embodiments 6 to 11, wherein the plasma refinement device comprises a vacuum port leading out from the chamber.

13. The ECD apparatus of any of embodiments 6 to 12, wherein the plasma refinement device comprises a device configured for confining plasma ions and electrons of the plasma plume along a straight or curved axis.

14. The ECD apparatus of any of embodiments 6 to 13, wherein the plasma refinement device comprises a wall between the plasma source and the interaction region, and the wall comprises an orifice through which at least a portion of the plasma plume passes.

15. The ECD apparatus of embodiment 14, wherein the plasma refinement device comprises a confining device configured for confining plasma ions and electrons of the plasma plume along an axis directed toward the orifice.

16. The ECD apparatus of embodiment 15, wherein the confining device comprises a magnet between the plasma source and the wall.

17. The ECD apparatus of embodiment 15, wherein the confining device comprises a first magnet positioned between the plasma source and the wall and a second magnet positioned at the wall and arranged coaxially about the orifice.

18. The ECD apparatus of embodiment 17, comprising a device configured for adjusting the flux density of the magnetic field applied by the second magnet.

19. The ECD apparatus of any of embodiments 14 to 18, wherein the plasma outlet and the orifice are oriented in different directions, and the plasma refinement device comprises a confining device configured for confining the plasma plume along a curved path from the plasma outlet to the orifice.

20. The ECD apparatus of embodiment 19, wherein the confining device comprises a first magnet and a second magnet oriented in different directions along the curved path.

21. The ECD apparatus of any of embodiments 6 to 20, wherein the plasma refinement device comprises a device configured for guiding the plasma plume along a path from the plasma outlet to the interaction region, and the path comprises at least one change in direction.

22. The ECD apparatus of any of embodiments 6 to 21, comprising a device for controlling a position relative to the plasma outlet at which the ion beam passes through the plasma plume, wherein the device for controlling comprises a device for moving the plasma outlet, a device for steering the ion beam, or a device for both moving the plasma outlet and a steering the ion beam.

23. The ECD apparatus of any of embodiments 1 to 22, wherein the plasma refinement device comprises a plasma pulsing device configured for alternately activating and deactivating the plasma in the plasma source.

24. The ECD apparatus of embodiment 23, wherein the plasma pulsing device comprises an energy source configured for applying energy to the plasma.

25. The ECD apparatus of any of embodiments 1 to 24, wherein the plasma refinement device comprises a device configured for introducing a quenching gas to the plasma source effective for de-exciting one or more types of metastable atoms of the generated plasma.

26. The ECD apparatus of any of embodiments 1 to 25, comprising a magnet assembly positioned at the interaction region and configured for applying a substantially uniform magnetic field to the plasma plume.

27. The ECD apparatus of embodiment 26, wherein the magnet assembly comprises a Helmholz coil or a Maxwell coil.

28. A mass spectrometer (MS) system, comprising: the ECD apparatus of embodiment 1; an ion source for producing analyte ions from a sample and communicating with the ECD apparatus; and a mass analyzer communicating with the ECD apparatus.

29. The MS system of embodiment 28, comprising an ion guide or a mass filter for transferring the analyte ions to the ECD apparatus.

30. The MS system of embodiment 28 or 29, comprising a collision cell between the ECD apparatus and the mass analyzer.

31. The MS system of any of embodiments 28 to 30, wherein the mass analyzer comprises a mass filter, an ion trap, or a time-of-flight analyzer.

32. The MS system of any of embodiments 28 to 31, wherein the mass analyzer comprises a flight tube and an ion accelerator for injecting packets of fragment ions into the flight tube.

33. The MS system of embodiment 32, wherein the plasma refinement device comprises a plasma pulsing device for cycling the plasma in the plasma source between an activated state and a deactivated state, and further comprising a device for synchronizing respective operations of the plasma pulsing device and the ion accelerator such that the ion accelerator injects packets of fragment ions produced only during a time period in which the analyte ions interact with deactivated plasma.

34. The MS system of any of embodiments 28 to 33, comprising an ion gate between the ion source and the ECD apparatus configured for alternately passing analyte ions to the ECD apparatus and preventing analyte ions from passing to the ECD apparatus.

35. The MS system of embodiment 34, wherein the plasma refinement device comprises a plasma pulsing device for cycling the plasma in the plasma source between an activated state and a deactivated state, and further comprising a device for synchronizing respective operations of the plasma pulsing device and the ion gate such that analyte ions enter the interaction region only when the interaction region contains deactivated plasma.

36. The MS system of any of embodiments 28 to 35, comprising an ion beam cooler between the ECD apparatus and the mass analyzer.

37. A method for performing electron capture dissociation (ECD), the method comprising: generating plasma; forming a refined plasma from the generated plasma wherein the refined plasma comprises predominantly low-energy electrons suitable for ECD and plasma ions; and directing an ion beam into the refined plasma.

38. The method of embodiment 37, wherein forming the refined plasma comprises removing from the plasma particles selected from the group consisting of: photons, metastable particles, neutral particles, high-energy electrons unsuitable for ECD; and a combination of two or more of the foregoing.

39. The method of embodiment 37 or 38, wherein forming the refined plasma comprises controlling a density of the low-energy electrons in the plasma.

40. The method of embodiment 39, wherein generating plasma comprises applying energy in a plasma source, and controlling the density of the low-energy electrons comprises a step selected from the group consisting of: adjusting the power at which the energy is applied in the plasma source; adjusting a flow rate of plasma-forming gas into the plasma source; applying energy in the plasma source according to a pulse-width modulated pulse wave; and a combination of two or more of the foregoing.

41. The method of any of embodiments 37 to 40, comprising generating plasma and forming the refined plasma in a plasma source, and directing the ion beam into the plasma source.

42. The method of any of embodiments 37 to 40, comprising emitting the generated plasma from a plasma source as a plasma plume, and directing the ion beam into the plasma plume.

43. The method of embodiment 42, comprising a step selected from the group consisting of: refining the plasma in the plasma source, wherein the emitted plasma plume comprises the refined plasma; refining the plasma of the plasma plume outside the plasma source; and refining the plasma in the plasma source, wherein the emitted plasma plume comprises the refined plasma, and further refining the plasma of the plasma plume outside the plasma source.

44. The method of embodiment 42 or 43, comprising emitting the plasma plume into a chamber, wherein forming the refined plasma comprises removing metastable particles and neutral particles of the plasma plume from the chamber.

45. The method of any of embodiments 42 to 44, wherein forming the refined plasma comprises confining plasma ions and electrons along an axis while allowing other particles of the plasma plume to diverge away from the axis.

46. The method of embodiment 45, wherein confining comprises applying a magnetic field to the plasma plume.

47. The method of any of embodiments 42 to 46, wherein forming the refined plasma comprises directing the plasma plume through an orifice in a wall positioned between the plasma source and an interaction region such that the wall prevents particles in a diverging portion of the plasma plume from entering the interaction region, and directing the ion beam comprises directing the ion beam into the interaction region.

48. The method of embodiment 47, wherein forming the refined plasma comprises applying a magnetic field such that plasma ions and electrons of the plasma plume are constrained by the orifice.

49. The method of embodiment 47 or 48, wherein forming the refined plasma comprises applying a magnetic field to the plasma plume to confine plasma ions and electrons along an axis, and adjusting the flux of electrons of the plasma plume passing through the orifice by adjusting the flux density of the magnetic field at the orifice.

50. The method of any of embodiments 47 to 49, wherein the plasma plume expands after entering the interaction region, and further comprising applying a magnetic field of substantially uniform flux density to the interaction region to confine the plasma plume to a beam having a diameter greater than a diameter of the ion beam.

51. The method of any of embodiments 42 to 50, wherein forming the refined plasma comprises confining plasma ions and electrons along a curved path, such that the plasma ions and electrons follow the curved path while other particles of the plasma plume diverge away from the curved path.

52. The method of any of embodiments 42 to 51, comprising adjusting a position relative to the plasma source at which the ion beam passes through the plasma plume.

53. The method of any of embodiments 42 to 52, wherein forming the refined plasma comprises directing the plasma plume over a distance through a chamber to an interaction region, the distance being sufficient to cool electrons of the plasma plume to an average energy of about 1 eV or less, and wherein directing the ion beam comprises directing the ion beam into the interaction region.

54. The method of any of embodiments 42 to 53, wherein forming the refined plasma comprises cycling between activating and deactivating the plasma in the plasma source.

55. The method of any of embodiments 37 to 54, wherein forming the refined plasma comprises introducing a quenching gas into the plasma source to de-excite one or more selected types of metastable particles generated in the plasma.

56. A method for analyzing a sample, the method comprising: subjecting analyte ions to electron capture dissociation (ECD) according to the method of embodiment 37 to produce fragment ions; and transferring at least some of the fragment ions to a mass analyzer.

57. The method of embodiment 56, comprising producing parent ions from a sample, and transferring parent ions of a selected mass or mass range to an ECD apparatus, wherein only the selected parent ions are subjected to ECD.

58. The method of embodiment 56 or 57, comprising, after producing the fragment ions, transferring the fragment ions to a collision cell to produce additional fragment ions, wherein at least some of the additional fragment ions are transferred to the mass analyzer.

59. The method of any of embodiments 56 to 58, wherein transferring at least some of the fragment ions comprises transferring fragment ions of a selected mass or mass range to the mass analyzer.

60. The method of any of embodiments 56 to 59, wherein forming the refined plasma comprises pulsing the plasma between an activated state and a deactivated state in an ECD apparatus, and further comprising: transferring the analyte ions from an ion source to an ion gate between the ion source and the ECD apparatus; cycling the ion gate between an open state during which analyte ions are transferred to the ECD apparatus and a closed state during which analyte ions are prevented from passing through the ion gate; and synchronizing the pulsing of the plasma with the cycling of the ion gate such that the analyte ions interact with the plasma only while the plasma has a composition evolved during deactivated state.

61. The method of any of embodiments 56 to 59, wherein the mass analyzer is a time-of-flight analyzer comprising an ion accelerator and a flight tube, and forming the refined plasma comprises pulsing the plasma between an activated state and a deactivated state in an ECD apparatus, and further comprising: transferring fragment ions to the ion accelerator; and synchronizing the pulsing of the plasma with cycling of the ion accelerator such that the ion accelerator injects into the flight tube fragment ions produced only from analyte ions that interacted with the plasma while the plasma had a composition evolved during deactivated state.

62. The method of any of embodiments 56 to 61, comprising cooling the fragment ions before transferring the fragment ions to the mass analyzer.

It will be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An electron capture dissociation (ECD) apparatus, comprising:

a plasma source configured for generating plasma;

a plasma refinement device configured for converting the generated plasma to refined plasma comprising predominantly low-energy electrons suitable for ECD and plasma ions; and a chamber configured for receiving an ion beam in an interaction region containing the refined plasma.

2. The ECD apparatus of claim 1, wherein the plasma refinement device is configured for removing plasma species from the plasma, and the plasma species are selected from the group consisting of: photons, metastable particles, neutral particles, high-energy electrons unsuitable for ECD; and a combination of two or more of the foregoing.

3. The ECD apparatus of claim 1, wherein the plasma refinement device is configured for controlling a density of the low-energy electrons in the plasma.

4. The ECD apparatus of claim 3, wherein the plasma source comprises an energy source configured for applying energy to the plasma in the plasma source, and the plasma refinement device has a configuration selected from the group consisting of:

the plasma refinement device is configured for adjusting the power at which the energy is applied to the plasma;

the plasma refinement device is configured for adjusting the flow rate of plasma-forming gas into the plasma source;

the plasma refinement device is configured for applying energy to the plasma according to a pulse-width modulated pulse wave; and a combination of two or more of the foregoing.

5. The ECD apparatus of claim 1, wherein the chamber is outside the plasma source, and the plasma source comprises a plasma outlet for emitting a plasma plume toward the chamber.

6. The ECD apparatus of claim 5, wherein the plasma refinement device has a configuration selected from the group consisting of:

the plasma refinement device is configured for converting the generated plasma to refined plasma in the plasma source, wherein the plasma plume comprises refined plasma;

the plasma refinement device is configured for refining the plasma of the emitted plasma plume; and the plasma refinement device is configured for converting the generated plasma to refined plasma in the plasma source, wherein the plasma plume comprises refined plasma, and the plasma refinement device is configured for further refining the plasma of the emitted plasma plume.

7. The ECD apparatus of claim 5, wherein the plasma refinement device comprises a confining device configured for confining plasma ions and electrons of the plasma plume along a straight or curved axis.

8. The ECD apparatus of claim 7, wherein the confining device is configured for guiding the plasma plume along a path from the plasma outlet to the interaction region, and the path comprises at least one change in direction.

9. The ECD apparatus of claim 5, wherein the plasma refinement device comprises a wall between the plasma source and the interaction region, and the wall comprises an orifice through which at least a portion of the plasma plume passes.

10. The ECD apparatus of claim 9, wherein the plasma refinement device comprises a confining device configured for confining plasma ions and electrons of the plasma plume along an axis directed toward the orifice.

11. The ECD apparatus of claim 10, wherein the confining device is selected from the group consisting of:

a confining device comprising a magnet between the plasma source and the wall;

a confining device comprising a first magnet positioned between the plasma source and the wall and a second magnet positioned at the wall and arranged coaxially about the orifice; and a confining device comprising a first magnet positioned between the plasma source and the wall and a second magnet positioned at the wall and arranged coaxially about the orifice, wherein the second magnet is configured for applying a magnetic field of adjustable flux density.

12. The ECD apparatus of claim 5, comprising a device for controlling a position relative to the plasma outlet at which the ion beam passes through the plasma plume, wherein the device for controlling comprises a device for moving the plasma outlet, a device for steering the ion beam, or a device for both moving the plasma outlet and a steering the ion beam.

13. The ECD apparatus of claim 1, wherein the plasma refinement device comprises a plasma pulsing device configured for alternately activating and deactivating the plasma in the plasma source.

14. The ECD apparatus of claim 1, wherein the plasma refinement device comprises a device configured for introducing a quenching gas to the plasma source effective for de-exciting one or more types of metastable atoms of the generated plasma.

15. The ECD apparatus of claim 1, comprising a magnet assembly positioned at the interaction region and configured for applying a substantially uniform magnetic field to the plasma plume.

16. A mass spectrometer (MS) system, comprising:

the ECD apparatus of claim 1;

an ion source for producing analyte ions from a sample and communicating with the ECD apparatus; and a mass analyzer communicating with the ECD apparatus.

17. The MS system of claim 16, wherein the mass analyzer comprises a flight tube and an ion accelerator for injecting packets of fragment ions into the flight tube, and the plasma refinement device comprises a plasma pulsing device for cycling the plasma in the plasma source between an activated state and a deactivated state, and further comprising a device for synchronizing respective operations of the plasma pulsing device and the ion accelerator such that the ion accelerator injects packets of fragment ions produced only during a time period in which the analyte ions interact with deactivated plasma.

18. The MS system of claim 16, comprising an ion gate between the ion source and the ECD apparatus configured for alternately passing analyte ions to the ECD apparatus and preventing analyte ions from passing to the ECD apparatus, wherein the plasma refinement device comprises a plasma pulsing device for cycling the plasma in the plasma source between an activated state and a deactivated state, and further comprising a device for synchronizing respective operations of the plasma pulsing device and the ion gate such that analyte ions enter the interaction region only when the interaction region contains deactivated plasma.

19. A method for performing electron capture dissociation (ECD), the method comprising:

generating plasma;

forming a refined plasma from the generated plasma wherein the refined plasma comprises predominantly low-energy electrons suitable for ECD and plasma ions; and directing an ion beam into the refined plasma.

20. A method for analyzing a sample, the method comprising:

subjecting analyte ions to electron capture dissociation (ECD) according to the method of claim 19 to produce fragment ions; and transferring at least some of the fragment ions to a mass analyzer.

* * * * *

UNITED STATES PATENT AND TRADEMARK OFFICE

CERTIFICATE OF CORRECTION

PATENT NO. : 9,105,454 B2
APPLICATION NO. : 14/483462
DATED : August 11, 2015
INVENTOR(S) : Trygve Ristroph et al.

It is certified that error appears in the above-identified patent and that said Letters Patent is hereby corrected as shown below:

In the specification,

In column 7, line 30, delete “by” and insert -- be --, therefor.

In column 23, line 61, delete “Helmholz” and insert -- Helmholtz --, therefor.

Signed and Sealed this
Twenty-ninth Day of March, 2016

Michelle K. Lee

Michelle K. Lee
*Director of the United States Patent and Trademark Office*